US006289831B1

(12) United States Patent
Hanai et al.

(10) Patent No.: US 6,289,831 B1
(45) Date of Patent: Sep. 18, 2001

(54) SEWING MACHINE CAPABLE OF TRACING AN EMBROIDERY AREA

(75) Inventors: Toshihiro Hanai, Nagoya; Kiyokazu Sekine, Mie-ken; Fumiaki Asano, Nagoya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/533,928

(22) Filed: Mar. 23, 2000

(30) Foreign Application Priority Data

Mar. 25, 1999 (JP) ..... 11-081366
Mar. 25, 1999 (JP) ..... 11-082532

(51) Int. Cl.[7] ..... D05B 21/00; D05C 9/16

(52) U.S. Cl. ..... 112/102.5; 112/275; 112/317

(58) Field of Search ..... 112/102.5, 470.01, 112/470.06, 221, 316, 317, 277, 275, 475.19; 700/136, 137, 138

(56) References Cited

U.S. PATENT DOCUMENTS 4,506,612 * 3/1985 Yanagi ..... 112/470.06
5,648,908 * 7/1997 Chirn et al. ..... 112/470.06 X

FOREIGN PATENT DOCUMENTS 3-67436 10/1991 (JP) .
5-61954 9/1993 (JP) .
9-137365 5/1997 (JP) .

* cited by examiner

*Primary Examiner*—Peter Nerbun
(74) *Attorney, Agent, or Firm*—Oliff & Berridge, PLC

(57) ABSTRACT

A sewing machine capable of tracing an embroidery area by relatively moving a needle bar as a sewing device and an embroidery frame which holds a work cloth on which an embroidery pattern is embroidered based on embroidery data, comprises a calculating device that calculates a convex polygon in multiples of eight covering the pattern inside from the embroidery data, and positions of a plurality of vertexes comprised of the convex polygon, and a trace device that traces the embroidery area based on the vertexes found by the calculating device.

31 Claims, 24 Drawing Sheets

SEWING MACHINE CAPABLE OF TRACING AN EMBROIDERY AREA

BACKGROUND OF THE INVENTION

1. Field of Invention

The invention relates to a sewing machine capable of sewing a cloth held by an embroidery frame and, in particular, to a sewing machine having a trace mode where an embroidery area is traced to confirm whether it is within an embroidery frame before sewing.

2. Description of Related Art

Conventionally, an embroidery machine with multiple needles with a single head or multiple heads, comprises an embroidery frame that holds a work cloth in which a pattern is embroidered or a movable frame attaching multiple embroidery frames thereto so as to move in the X- and Y-axis directions on an X–Y coordinate system. The embroidery machine further comprises a needle bar changing mechanism that selectively changes multiple needle bars, and a thread trimming mechanism that allows needle and bobbin threads to be cut, for example, every time a needle bar is changed, for a color change, by the needle bar changing mechanism based on embroidery data. Thus, the embroidery machine enables colorful embroidering with different color threads by moving the embroidery frame and driving these mechanisms.

As to the embroidery frame, a variety of shapes are prepared so as to conform to a size and a shape of a pattern to be embroidered, such as rectangle, that is a basic shape, an oval, ellipse, or circle which are substantially a rectangle with the four corners rounded off in different ways. Using different shape frames, various patterns are embroidered on plain and tubular cloths.

In an embroidery factory, it is usual to perform a trace operation in advance, in order to prevent an accident where the needle hits the embroidery frame during embroidering from happening. The trace operation is to make a master needle bar trace in an embroidery area, by moving the embroidery frame based on embroidery data, in order to check whether the pattern is placed within the embroidery frame.

In Japanese Patent Publication No. 3-67436, the applicant of this application proposed a sewing machine that enables an operator to confirm a sewing area. In the sewing machine, a trace area in a rectangle circumscribing an outline of a pattern is calculated based on the embroidery data, and the embroidery frame is moved along the outline of the tracing area before embroidering. Because the operator watches to check whether the entire range of the trace area fits inside of the embroidery frame, the accident where the needle hits the embroidery frame can be prevented.

However, in the above-mentioned patent, the calculation to determine the trace area is performed for a rectangle only even if the pattern has a shape close to an oval or ellipse, i.e., no pattern extends to the four corners of the rectangle. As a result, the trace area greatly differs from the actual pattern shape, which may cause a trace error because only corners of the entire range of the trace area are partially out of the embroidery frame although the actual pattern itself does not reach the corners. In this case, an embroidery frame considerably larger than the actual pattern size is needed.

When an embroidery frame considerably larger than the actual pattern size is used, appropriate tension can not be applied to a cloth held by the frame, stitches are not formed beautifully, and the entire quality of the embroidery becomes worse in the end.

In Japanese Patent Publication No. 5-61954, a trace operation is performed along an outline that is almost identical to an actual pattern. The outline is determined based on the relationship among all needle points in the embroidery data. Because the outline determined in this manner is used for a trace operation, it is possible to precisely confirm whether the entire of embroidery area is surely set inside the embroidery frame.

However, the calculation to determine the outline in this manner includes many steps because it has to be done based the relationship among all needle points in the embroidery data. For a large pattern to be embroidered, with 20,000 to 50,000 stitches, its data processing volume becomes enormous, and its processing time is consequently prolonged. In addition, its trace operation time is also prolonged since a trace is performed perfectly along all needle points on the outline. This means the operator must observe the trace operation during the same prolonged time, which lowers efficiency in the trace checking operation and finally affects the entirety of embroidering operations.

On the other hand, a conventional trace is performed, based on the embroidery data, at a uniform speed without stopping. However, in a case that the embroidery area is very close to the embroidery frame, it is difficult to determine whether there is a possibility of an accident where the needle bar hits the embroidery frame, only at one try. As a result, the trace should be repeatedly performed until the operator recognizes whether the trace has a problem that leads to such an accident.

As against this, a more accurate and prompt trace method is proposed in Japanese Laid-Open Patent Application Publication No. 9-137365. The trace speed is controlled by a program that enables the trace speed to change based on the positional relationship between the embroidery area and the embroidery frame.

However, the trace operation is observed by the operator. In the above-mentioned trace methods, it is impossible for an operator to change the trace speed because trace operation is controlled by the program. Further, when the operator wants to check a part of the trace again, it is necessary to retrace the embroidery area from the very beginning.

SUMMARY OF THE INVENTION

The invention was made in consideration of the above circumstances. A first object of the invention is to provide a sewing machine capable of tracing an embroidery area with high flexibility so as to enable user-oriented trace operations. A second object is to find the embroidery area in various shapes, such as polygons and convex polygons including an octagon and circles, depending on a shape of the embroidery frame to be used. A third object is to enable the direction of the trace operation to reverse on the way.

In the first embodiment to accomplish the first and second objects, a sewing machine capable of tracing an embroidery area by relatively moving a needle bar as a sewing device and an embroidery frame which holds a work cloth on which an embroidery pattern is embroidered based on embroidery data, comprises a calculating device that calculates a convex polygon in multiples of eight covering the pattern inside from the embroidery data, and positions of a plurality of vertexes comprised of the convex polygon, and a trace device that traces the embroidery area based on the vertexes found by the calculating device.

The embroidery area to be traced is given as the convex polygon that the four corners are removed from the rectangle conventionally used. Further, the convex polygon is specified in multiples of eight, and covers the embroidery area therein. Therefore, the trace operation can be performed substantially along the outline of the embroidery pattern because the polygonal embroidery area is closer to the embroidery pattern than the rectangular one. Even when the embroidery frame is an oval or a rectangle, it is easy to confirm where the embroidery area is placed with respect to the embroidery frame.

In addition, the total length of all sides comprised of the convex polygon in multiples of eight is found to be shorter than that of the rectangle conventionally used. Therefore, this shortens the time taken for the trace operation in which the embroidery frame is moved relative to the needle along the embroidery area and the time taken for confirmation of trace operation, improving the entire trace operation.

In a preferred aspect of the invention, a calculating device calculates a convex octagon that circumscribes a plurality of needle points of all points comprised of an outline of the pattern using a predetermined graphic arithmetic logic, and positions of eight vertexes of the convex octagon, and a trace device traces the embroidery area based on the eight vertexes found by the calculating device.

The embroidery area to be traced is given as the convex octagon that the four corners can be removed from a rectangle conventionally used and circumscribes a plurality of points of needle points comprised of an outline of the pattern. Therefore, the trace operation can be performed substantially along the outline of the embroidery pattern because the octagonal embroidery area is closer to the embroidery pattern than the rectangular one. Even when the embroidery frame is an oval or a rectangle, it is easy to confirm where the embroidery area is placed in respect to the embroidery frame.

Further, it is easy to find eight sides and eight vertexes comprised of the convex octagon that circumscribes a plurality of points of needle points comprised of an outline of the pattern, using a predetermined arithmetic logic. This helps to reduce the calculation time. In addition, the total length of the eight sides of the convex octagon is found to be shorter than that of four sides of a rectangle conventionally used. This also helps to shorten the time taken for trace operation in which the embroidery frame is moved relative to the needle and the time taken for confirmation of the trace operation, improving the confirmation of the trace operation.

For a convex octagon having a side with an inclination of 45 degrees in respect to the X axis, the calculating device obtains the side having gradient "1" or "−1" from the (X−Y) coordinate system or the (X+Y) coordinate system. Therefore, the octagon can be easily determined without complicated trigonometric functions.

In a further preferred aspect of the invention, the calculating device moves eight lines that are parallel to each side of a convex octagon in a random shape, in parallel respectively, until each line is on a needle point at which it is met first with, of needle points included in the embroidery data. Then, the calculating device turns each line on the needle point at the point until it meets with another needle point on the outline of the embroidery pattern. Then the calculating device finds intersection points at which adjacent lines of eight sides cross each other to define eight vertexes. Thus, the convex octagon, which covers the embroidery pattern therein and is more approximate to the outline of the embroidery pattern, can be found from the eight vertexes.

In another preferred aspect of the invention, a calculating device calculates an envelope polygon covering the embroidery pattern inside, and a trace device traces the embroidery area based on vertexes of the envelope polygon found by the calculating device.

The calculating device first moves a line having an inclination in parallel until it first meets with a point of a plurality of needle points on the outline of the pattern, and regards the point as a first vertex. The calculating device turns the line on the first vertex at the vertex until it meets with another point on the outline, and regards the point as the next vertex. The device repeats the above steps until the last vertex of the polygon is found, and calculates positions of all vertexes comprising the envelope of the polygon.

The embroidery area to be traced is given as the envelope polygon such that the peripheral part is removed from a rectangle conventionally used and covers the embroidery pattern inside. Therefore, the trace operation can be performed substantially along the outline of the embroidery pattern because the envelope-polygonal embroidery area is closer to the embroidery pattern than the rectangular one. Even when the embroidery frame is oval or rectangle, it is easy to confirm where the embroidery area is placed in respect to the embroidery frame.

In addition, the total length of all sides comprising the envelope polygon is found to be shorter than that of a rectangle conventionally used. This helps to shorten the time taken for the trace operation in which the embroidery frame is moved relative to the needle and the time taken for confirmation of the trace operation, improving the trace operation.

In a further preferred aspect of the invention, a calculating device calculates a circle covering the embroidery pattern inside based on the embroidery data, and a trace device traces the embroidery area along the circle found by the calculating device.

The embroidery area to be traced is given as the circle that covers the embroidery pattern inside. Therefore, the trace operation can be performed substantially along the outline of the embroidery pattern because the circular embroidery area is closer to the embroidery pattern than the rectangular one. Even when the embroidery frame is oval or circular, it is easy to confirm where the embroidery area is placed with respect to the embroidery frame.

In addition, the circumference of a circle nearly conforming to the outline of the embroidery pattern is found to be shorter than the total length of four sides of a conventional rectangle. Therefore, this helps to reduce the time taken for the trace operation in which the embroidery frame is moved relative to the needle, improving the trace operation.

The calculating device calculates a center point of an imaginary rectangle which circumscribes the outline of the embroidery pattern, and a distance from the center point to the farthest point of all points on the outline as a radius, and finally finds the circle specified with the center point and the radius. Thus, the circle that is more approximate to the embroidery pattern can be determined accurately.

In another preferred aspect of the invention, the sewing machine comprises a trace shape selecting device that selects a trace shape from a plurality of various shape alternatives, a calculating device that calculates a trace shape selected through the trace shape selecting device based on the embroidery data so that it can cover the embroidery pattern inside, and a trace device that traces the embroidery area along the trace shape found by the calculating device.

When a desired trace shape is selected from alternatives, such as a convex octagon, an envelope polygon, and a circle, the selected shape is calculated. Therefore, the embroidery area represented by the selected shape can be traced.

In the second embodiment to accomplish the first and third objects, the sewing machine comprises a reverse trace executing device that moves the embroidery frame in an opposite direction in a trace mode where the needle and the embroidery frame are relatively moved in a predetermined direction along a predetermined path of the embroidery area for the pattern with the needle raised.

When it is hard for the operator to recognize where the needle position is in the embroidery frame in the trace mode, the reverse trace executing device allows the trace operation to retrace the path, and the operator can double-check the needle position exactly. Therefore, the trace operation is performed flexibly.

In another preferred aspect of the invention, the reverse trace executing device executes reverse trace only while an operating member for execution is manipulated. Therefore, the performance of the reverse trace can be changed promptly, which greatly increases the convenience of operation in the trace mode.

In a further preferred aspect of the invention, a first specifying device specifies a normal trace mode, and a second specifying device specifies a reverse trace mode where the direction of the trace is reversed.

Therefore, a direction of the trace can be selected at will, which greatly increases the convenience of operation in the trace mode.

In another preferred aspect of the invention, the reverse trace executing device allows a speed of the reverse trace to be changed only while a speed changing member is manipulated. Therefore, the speed of the reverse trace can be changed promptly, which greatly increases the convenience of operation in the trace mode.

In a further preferred aspect of the invention, the reverse trace executing device sets the speed of the reverse trace when a speed setting member is manipulated.

Therefore, the reverse trace can be performed at a desired speed, which greatly increases the convenience of operation in the trace mode.

In another preferred aspect of the invention, the reverse trace executing device reduces the speed of the reverse trace around a place where the direction of the trace operation changes when a speed reducing member is manipulated. Therefore, the operator can easily recognize the trace position around the place where the direction of the trace operation changes, which increases the convenience of operation in the trace mode.

In a further preferred aspect of the invention, the reverse trace executing device stops the trace operation at a next stop position when a stopping member for the next stop position is manipulated. Therefore, the operator can stop the trace at a desired position and easily recognize the trace position because the trace is suspended, which increases the convenience of operation in the trace mode.

In another preferred aspect of the invention, the reverse trace executing device specifies a stop position for the trace operation when an operating member for specifying stop position is manipulated. Therefore, the operator can stop the trace at a desired position and easily recognize the trace position because the trace is suspended, which increases the convenience of operation in the trace mode.

In a further preferred aspect of the invention, a speed changing device changes a speed of trace operation in the trace mode only while a speed changing member is manipulated. When it is hard for the operator to recognize where the needle position is in the embroidery frame in the trace mode, the speed changing device allows the speed of the trace operation to be reduced, and the operator can recognize the needle position exactly. Further, when the speed changing member is canceled, the speed of the trace operation returns to its original speed. Therefore, the speed can be easily changed, which increases the convenience of operation in the trace mode.

In another preferred aspect of the invention, a trace stopping device stops the trace operation only when an operating member for specifying a stop position is manipulated in the trace mode. When it is hard for the operator to recognize where the needle position is in the embroidery frame in the trace mode, the reverse trace executing device allows the trace operation to retrace the path, and the operator can double-check the needle position exactly. Further, the trace operation is not suspended unless the operating member for specifying a stop position is manipulated. Therefore, the trace operation can be suspended easily, which increases the convenience of operation in the trace mode.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A first embodiment of the invention will be described in detail with reference to the accompanying drawings.

The first embodiment of the invention is an example of the invention being applied to an embroidering machine with multiple needles.

Figure 1:
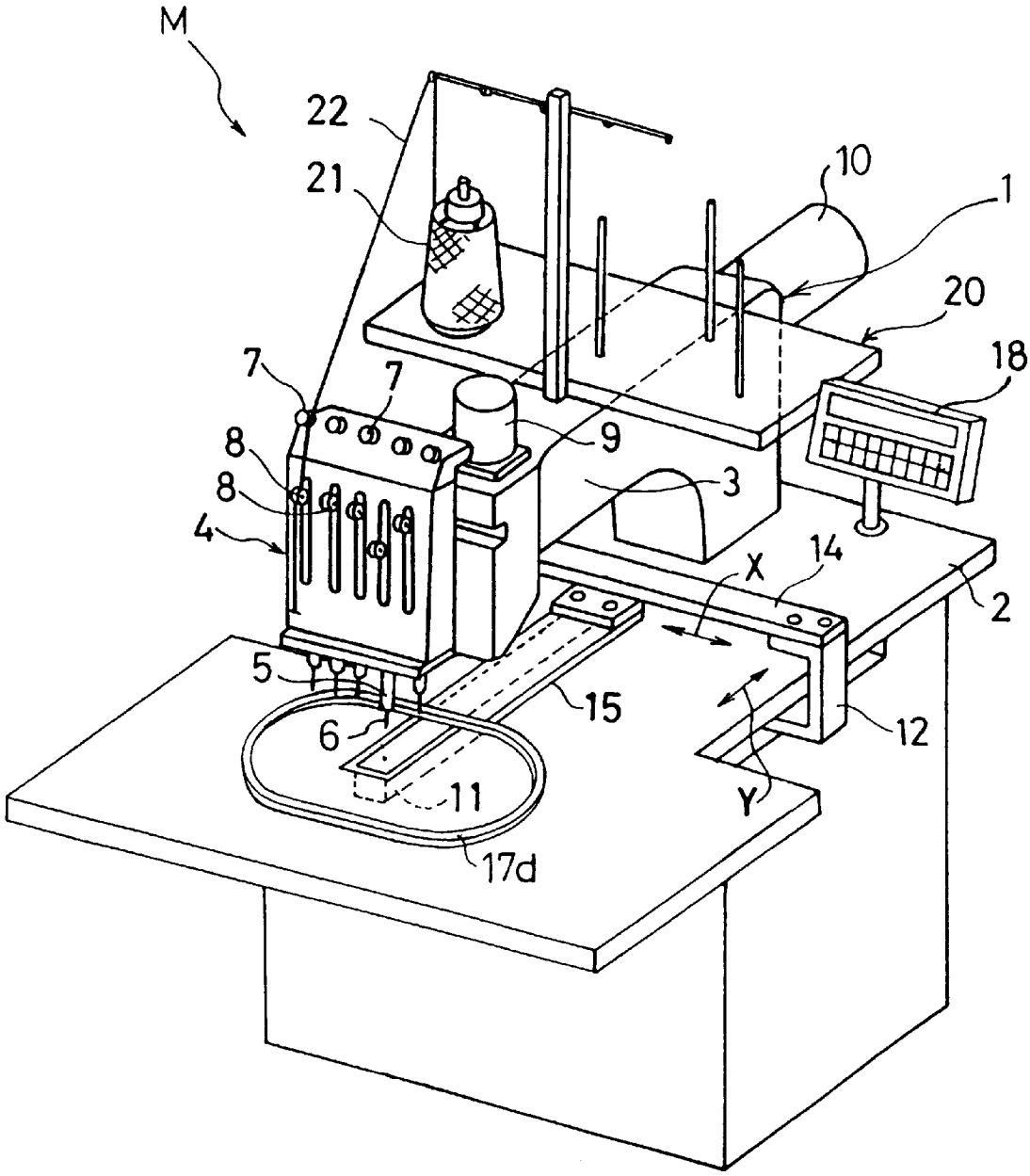
FIG. 1 is a perspective view of an embroidery machine having multiple needles in a first embodiment of the invention.

FIG. 1 illustrates an embroidering machine with multiple needles M in a perspective view. A machine body 1 is mounted on a machine table 2. At the front of an arm portion 3 of the machine body 1, a needle bar supporting case 4 is provided. The needle bar supporting case 4 has five needle bars 5 therein so as to move them up and down. The needle bar supporting case 4 is allowed to move in the left and right directions via the power of a needle bar change motor 9, and accordingly one of needle bars 5, which is selected, is moved up and down via the power of a machine motor 10. An operation panel 18, attached to the machine table 2, comprises a plurality of switches and function keys, and a small LCD display, which are related to embroidery.

Each needle bar 5 has a needle 6 on its bottom. A thread 22 is supplied from a spool 21 on a spool stand 20, which is placed on the arm portion 3, via a thread tension 7 and a thread take-up 8, finally to an eye of the needle 6.

On the underside of the machine table 2, a cylinder bed 11 for the machine main body 1 is disposed expanding toward the front. The cylinder bed 11 inside includes a loop taker (not shown) that cooperates with the needle 6 to form stitches on a work cloth, and a thread trimming mechanism (not shown) that cuts the thread 22 and a bobbin thread for thread changing or at the end of embroidering.

Figure 2:
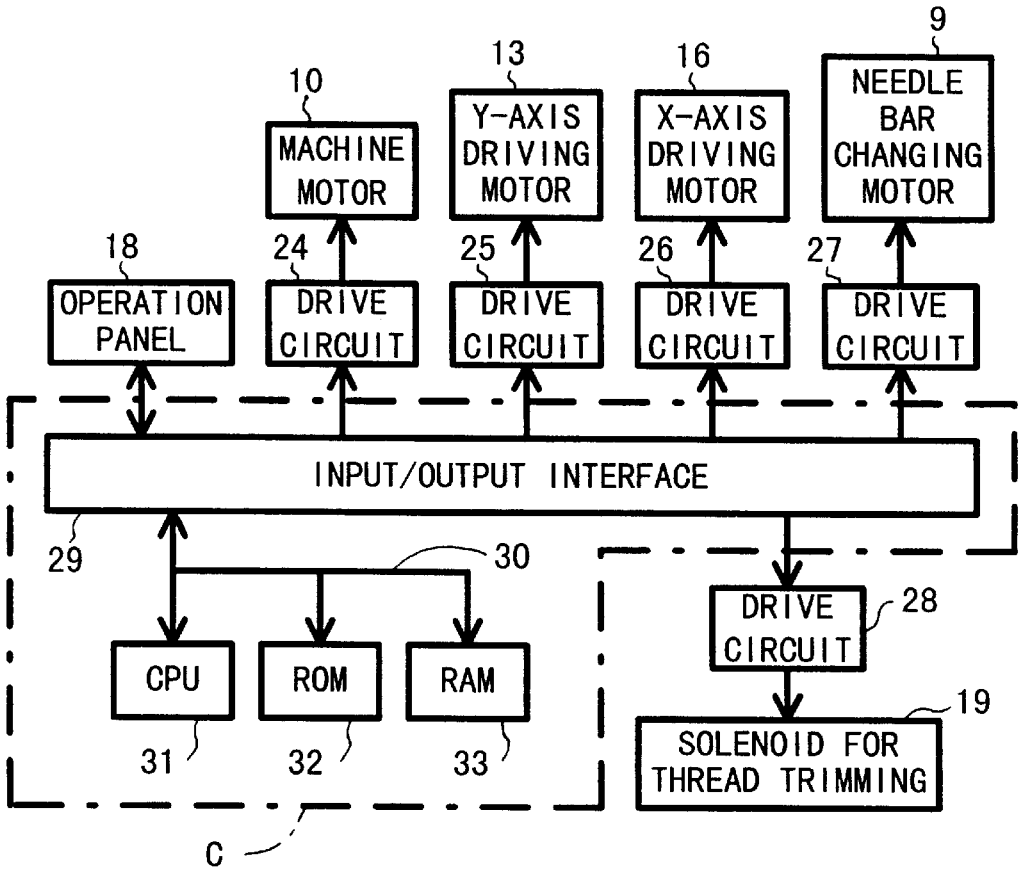
FIG. 2 is a control block diagram of the embroidery machine.

A pair of Y-axis moving arms 12 (only one illustrated) protrude upward on both ends of the machine table 2. The Y-axis moving arms 12 are movable in a Y-axis direction (in back and forth direction) via a Y-axis driving motor 13 (FIG. 2). A supporting member 14 extending laterally is hung across the pair of arms 12. An X-axis moving arm 15 is attached to the supporting member 14 so that it can be moved in the X-axis direction via an X-axis driving motor 16 (FIG. 2).

An oval embroidery frame 17d, which is attached to the front of the X-axis moving arm 15, detachably holds a work cloth. In other words, a work cloth set in the embroidery frame 17*d* is moved in the Y-axis direction by the Y-axis moving arms 12 which are driven by the Y-axis driving motor 13, and in the X-axis direction by the X-axis moving arm 15 which is driven by the X-axis driving motor 16. Thus, various embroidery patterns, such as letters and figures, are formed on a work cloth.

The control system of the machine M is as shown in the block diagram of FIG. 2. The operation panel 18, a drive circuit 24 for running the machine motor 10, a drive circuit 25 for running the Y-axis driving motor 13, a drive circuit 26 for running the X-axis driving motor 16, a drive circuit for running the needle bar changing motor 9, and a drive circuit 28 for operating a solenoid 19 for thread trimming are all connected to an input/output interface 29 of a controller C. The controller C comprises a CPU 31, a ROM 32, a RAM 33, and the I/O interface 29, which are connected via a bus 30.

The ROM 32 stores therein a plurality of embroidery data for each embroidery pattern, a control program for embroidering formed by driving the Y-axis driving motor 13 and the X-axis driving motor 16 based on the embroidery data, and a control program for tracing an embroidery area, which is peculiar to the invention and will be described later. The embroidery data for each embroidery pattern includes a plurality of coordinates representing points where the needle penetrates, in the pattern, a work cloth. The coordinates of the needle penetration points are stored in terms of the relative X, Y distance from the previous point. The RAM 33 provides a variety of areas including a work area that is necessary for embroidering, and a temporary storage area for results calculated by the CPU 31.

Next is an explanation of the routines for tracing an embroidery area which are executed in the controller C of the machine M with reference to FIGS. 3 to 7. In the flowcharts, Si (i=1, 2, 3 . . . ) stands for a procedure step.

Figure 3:
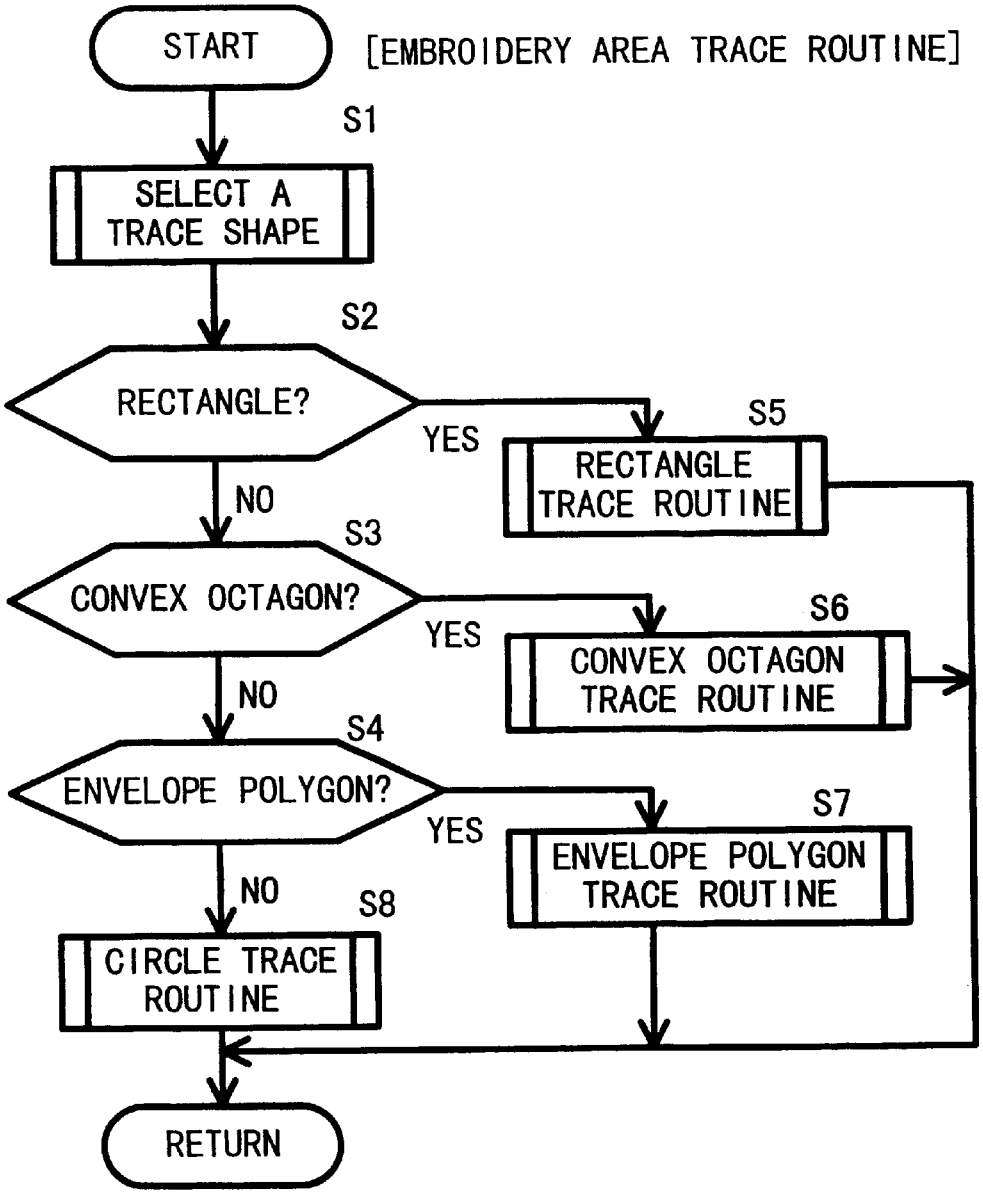
FIG. 3 is a flowchart of an embroidery area trace routine.

An embroidery pattern is selected using the operation panel 18, a trace key that executes a tracing operation is pressed, and an embroidery area trace routine is executed (FIG. 3). When the embroidery pattern is selected, the coordinates of the needle penetration points included in the embroidery data are premised to be converted to absolute coordinates on the X–Y coordinate system.

When the trace routine is started, a trace shape is selected (S1). An operator makes a choice among four shape alternatives displayed on the LCD display of the operation panel 18 by specifying a desired number: 1: rectangle, 2: convex octagon, 3: envelope polygon, and 4: circle. When the operator selects "1: rectangle" (S2: Yes), a rectangle trace routine (FIG. 4) is executed (S5).

Figure 4:
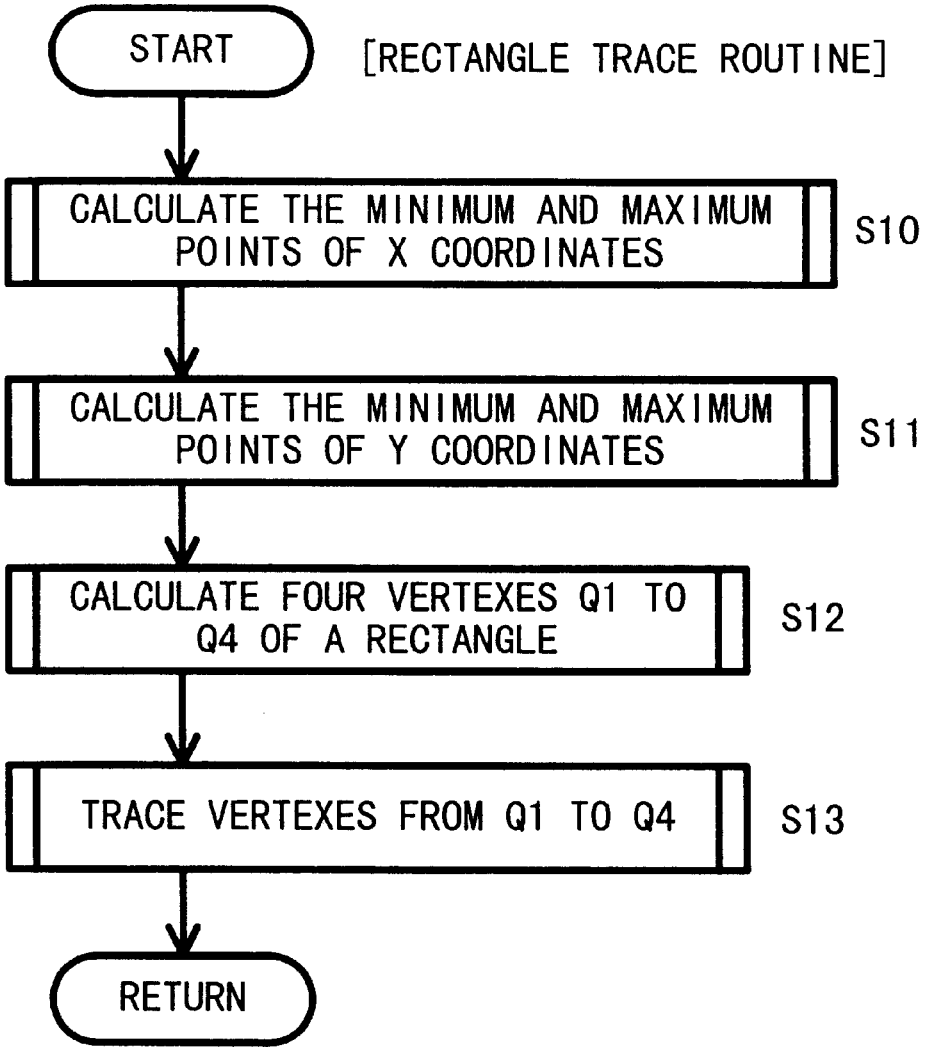
FIG. 4 is a flowchart of a rectangle trace routine.
Figure 8:
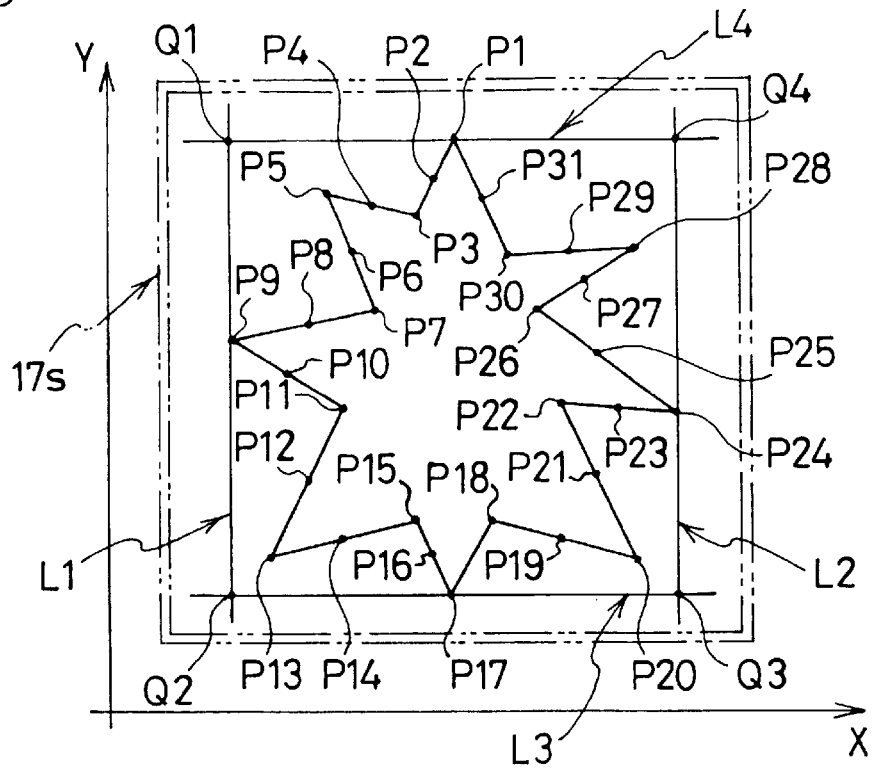
FIG. 8 describes how to find a rectangle area conforming to an embroidery pattern.

The rectangle trace routine will be now described with reference to FIGS. 4 and 8. In this routine, an embroidery area is defined as a rectangular shape as close in size to the objective pattern as possible. First, in the X–Y coordinate system, the minimum point P9 (x9, y9) of the X coordinates, the straight line L1 that passes through point P9 vertically (X=x9), the maximum point P24 (x24, y24) of the X coordinates, and straight line L2 that passes through point P24 vertically (X=x24), are determined by calculation (S10). Then, the minimum point P17 (x17, y17) of the Y coordinates, the straight line L3 that passes through point P17 horizontally (Y=y17), the maximum point P1 (x1, y1 ) of the Y coordinates, and straight line L4 that passes through point P1 horizontally (Y=y1), are determined by calculation (S11).

Finally, four points Q1 to Q4, at which the four lines L1 to L4 intersect each other to form a rectangle, are determined by calculation (S12). In FIG. 8, needle penetration points P1, P2, P3, . . . P31 are small portion of all points comprised of the embroidery pattern, and their coordinates are regarded as P1 (x1, y1), P2 (x2, y2), P3 (x3, y3), . . . P31 (x31, y31) respectively.

So as to enable the needle 6 to trace the points Q1, Q2, Q3, and Q4 in this order based on their coordinate data, the drive signals are sent to the X-axis driving motor 16 and the Y-axis driving motor 13. Accordingly, the embroidery frame 17 is moved so that the needle 6 can trace the points Q1, Q2, Q3, and Q4, and trace operation is performed rectangularly (S13). When this routine and the embroidery area trace routine are finished, the CPU 31 returns to the main routine. Because the rectangle embroidery area specified with points Q1 to Q4 is traced within the embroidery frame 17*s* as shown in FIG. 8, the operator can make sure that the needle 6 does not hit on the embroidery frame 17*s* during embroidering.

When the operator selects "2: convex octagon" in the embroidery area trace routine (S2: No, S3: Yes), a convex octagon routine is executed (S6).

Figure 5:
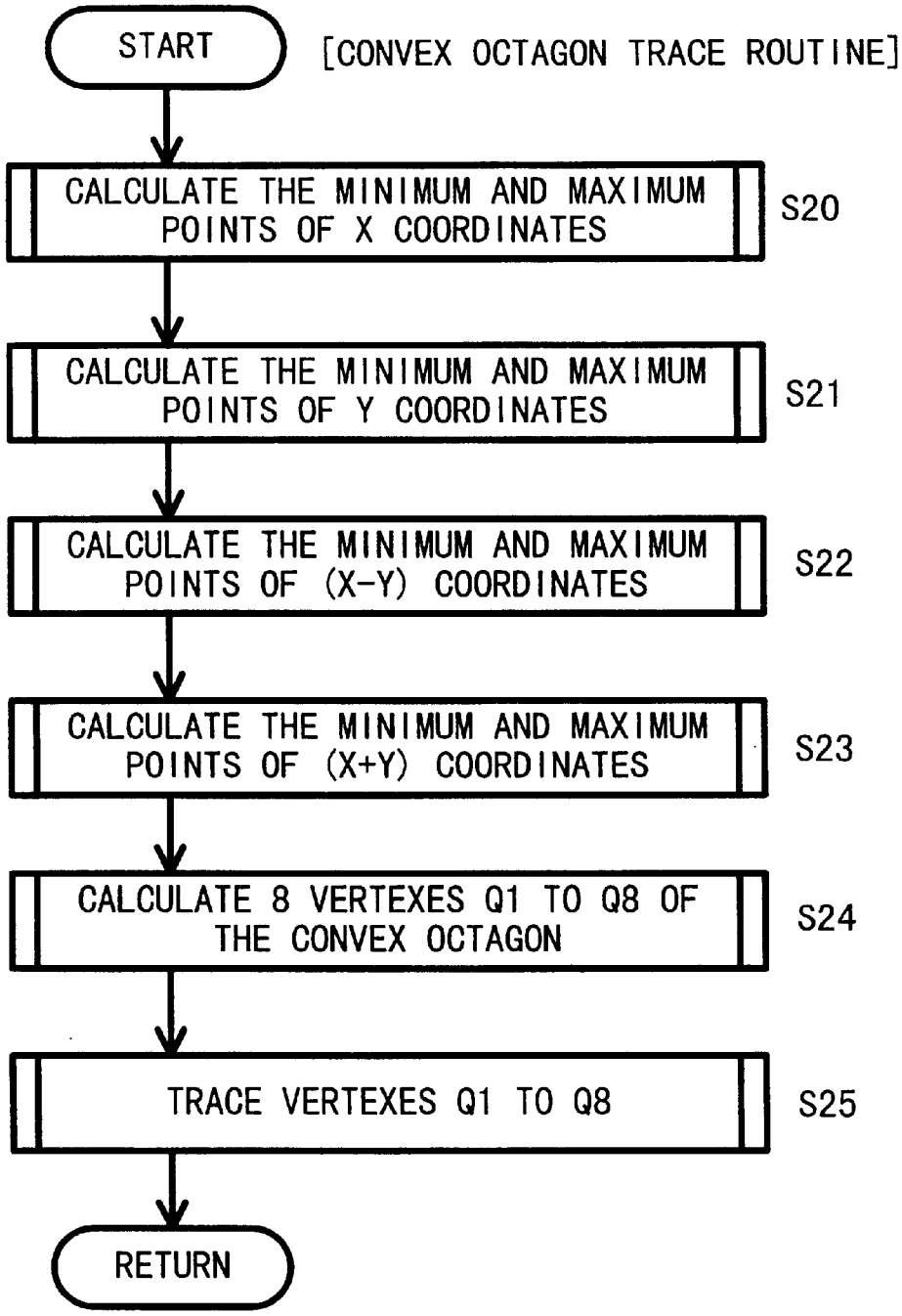
FIG. 5 is a flowchart of a convex octagon trace routine.
Figure 9:
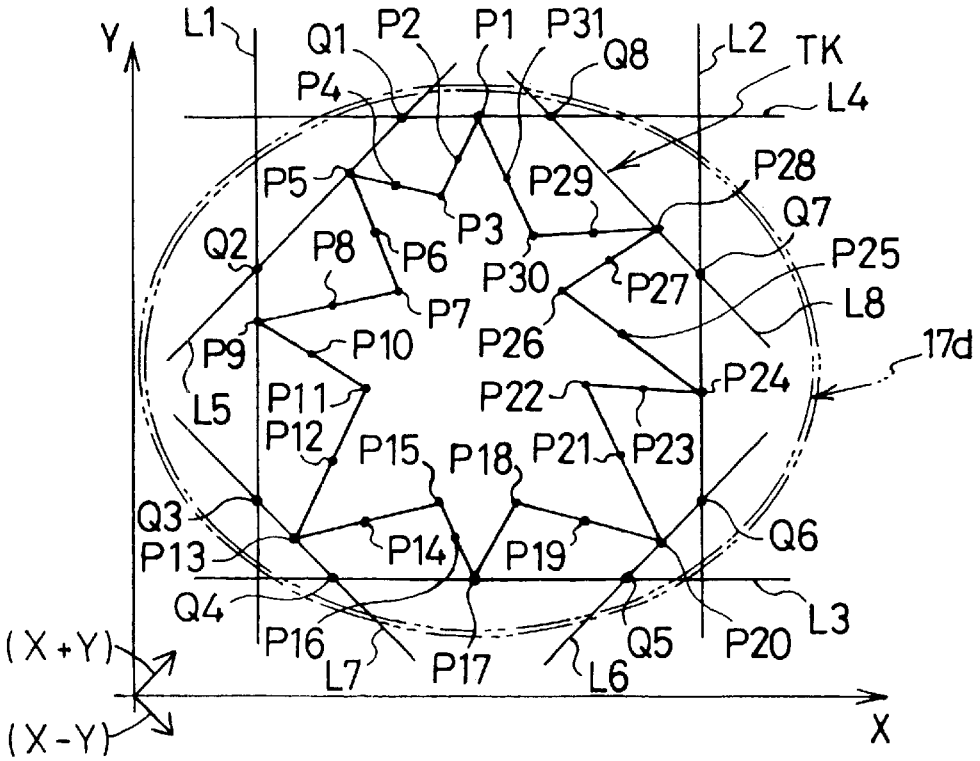
FIG. 9 describes how to find a convex octagon area conforming to an embroidery pattern.

The convex octagon routine will be now described with reference to FIGS. 5 and 9. In this routine, an embroidery area is determined in a convex octagon shape so as to be close in size to the objective pattern. Firstly, in the X–Y coordinate system, the minimum point P9 (x9, y9) of the X coordinates, the straight line L1 that passes through point P9 vertically (X=x9), the maximum point P24 (x24, y24) of the X coordinates, and straight line L2 that passes through point P24 vertically (X=x24), are determined by calculation (S20).

Next, the minimum point P17 (x17, y17) of the Y coordinates, the straight line L3 that passes through point P17 horizontally (Y=y17), the maximum point P1 (x1, y1) of the Y coordinates, and straight line L4 that passes through point P1 horizontally (Y=y1), are determined by calculation (S21). Then, in a (X minus Y) coordinate system (hereinafter "(X–Y) coordinate system"), the minimum point P5 (x5, y5) in a first direction of the (X–Y) coordinate system (gradient "1", or an inclination of 45 degrees with respect to the X axis), the straight line L5 (Y=X–x5+y5) that passes through point P5 in the first direction, the maximum point P20 (x20, y20) in the first direction, and the straight line L6 (Y=X–x20+y20) that passes through point P20 in the first direction, are determined by calculation (S22). Hereupon, the (X–Y) coordinate system can be obtained by rotating the X–Y coordinate system 45 degrees clockwise (FIG. 9).

Further, in a (X plus Y) coordinate system (hereinafter "(X+Y) coordinate system"), the minimum point P13 (x13, y13) in a second direction of the (X+Y) coordinate system (gradient "–1", or an inclination of –45 degrees (counter clockwise) with respect to the X axis), the straight line L7 (Y=–X+x13+y13) that passes through point P13 in the second direction, the maximum point P28 (x28, y28) in the second direction, the straight line L8 (Y=–X+x28+y28) that passes through point P28 in the second direction, are determined by calculation (S23). Hereupon, the (X+Y) coordinate system can be obtained by rotating the X–Y coordinate system 45 degrees counter clockwise (FIG. 9). Finally, the coordinates of eight points Q1 to Q8, at which the eight lines L1 to L8 intersect each other to form a convex octagon TK, are determined by calculation (S24). In FIG. 9, needle penetration points P1, P2, P3, . . . P31 are small portion of all points comprised of the embroidery pattern, and their coordinates are regarded as P1 (x1, y1), P2 (x2, y2), P3 (x3, y3), . . . P31 (x31, y31) respectively.

The calculation of the coordinates of points Q1 to Q8 will be now described using formulas. The coordinates of point Q1 where lines L4 and L5 intersect are expressed by (x5+y1-y5, y1) by substituting expressions "Y=y1" and "y1=(X–x5+y5)". The coordinates of point Q2 where lines L5 and L1 intersect are expressed by (x9, y5+x9–x5) by substituting expressions "X=x9" and "Y=(–x9+x13+y13)". The coordinates of point Q3 where lines L1 and L7 intersect are expressed by (x9, y13+x13–x9) by substituting expressions "X=x9" and "Y=(–x9+x13+y13)". The coordinates of point Q4 where lines L7 and L3 intersect are expressed by (x13+y13–y17, y17) by substituting expressions "Y=y17" and "y17=(–X+x13+y13)".

The coordinates of point Q5 where lines L3 and L6 intersect are expressed by (x20+y17–y20, y17) by substituting expressions "Y=y17" and "y17=(X–x20+y20)". The coordinates of point Q6 where lines L6 and L2 intersect are expressed by (x24, y20+x24–20) by substituting expressions "X=x24" and "Y=(x24–x20+y20)". The coordinates of point Q7 where lines L2 and L8 intersect are expressed by (x24, y28+x28–x24) by substituting expressions "X=x24" and "Y=(–x24+x28+y28)". The coordinates of point Q8 where lines L8 and L4 intersect are expressed by (x28+y28–y1, y1) by substituting expressions "Y=y1" and "y1=(–X+x28+y28)".

So as to enable the needle 6 to trace the points Q1, Q2, Q3, Q4, Q5, Q6, Q7, and Q8 in this order based on their coordinate data, the drive signals are sent to the X-axis driving motor 16 and the Y-axis driving motor 13. Therefore, the embroidery frame 17 is moved so that the needle 6 can relatively position on the points Q1, Q2, Q3, Q4, Q5, Q6, Q7, and Q8, and the trace operation is performed in a convex octagon (S25). When the routine and the embroidery area trace routine are finished, the CPU 31 returns to the main routine. Because the convex octagon TK specified by points Q1 to Q8 is traced within the embroidery frame 17*d* as shown in FIG. 9, the operator can be sure that the needle 6 does not hit the embroidery frame 17*d* during embroidering.

When the operator selects "3: envelope polygon" in the embroidery area trace routine (S2, S3: No, S4: Yes), an envelope polygon routine (FIG. 6) is executed (S7).

Figure 6:
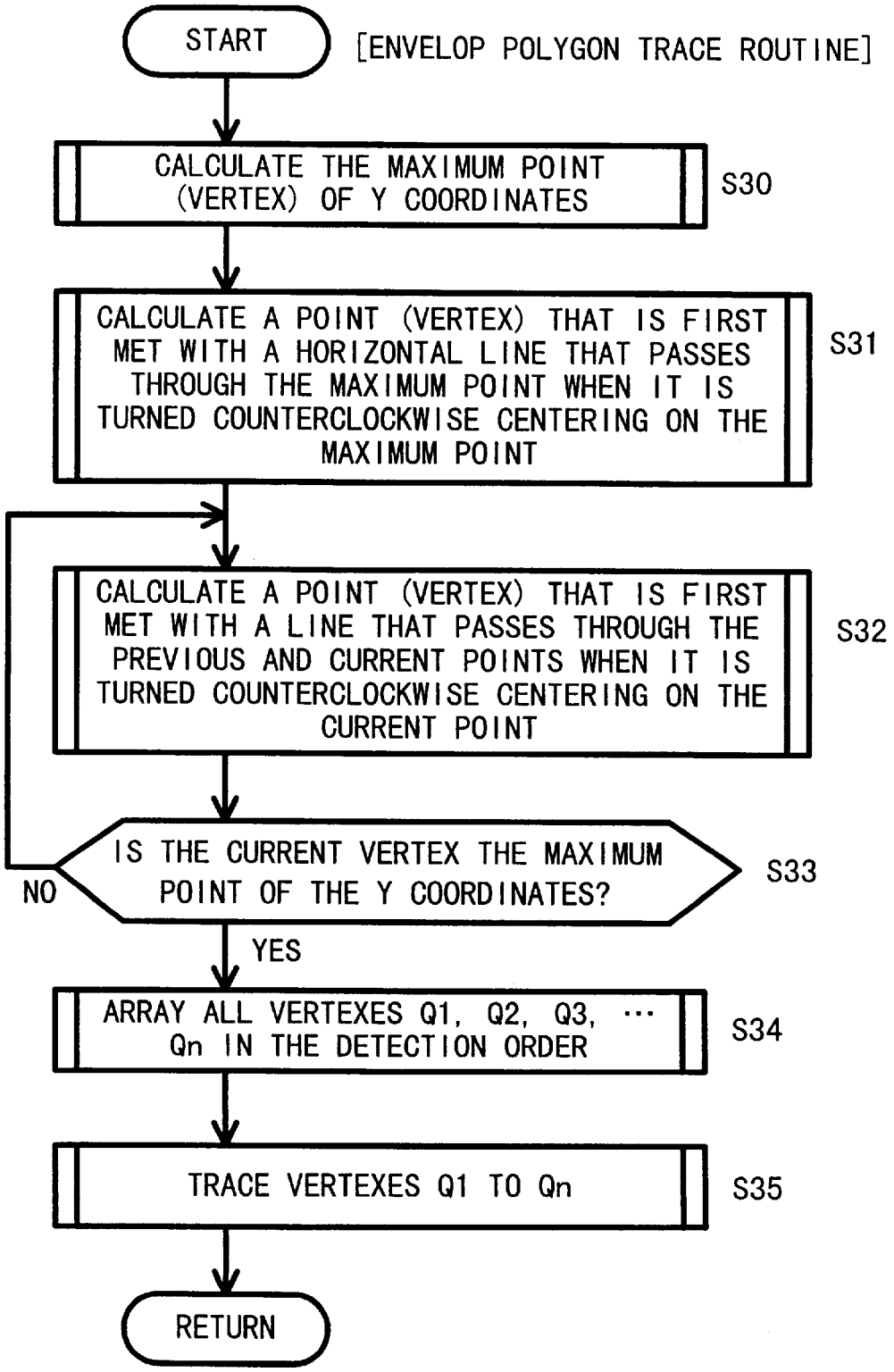
FIG. 6 is a flowchart of an envelope polygon trace routine.

The envelope polygon routine will be described with reference to FIGS. 6 and 10. In this routine, an embroidery area is defined by an envelope polygon shape so as to be close in size to an objective pattern. Firstly, in the X–Y coordinate system, the maximum point P1 (x1, y1) of the Y coordinate is determined by calculation as a first vertex of a polygon (S30). Then, a horizontal line that passes through point P1, line L10, is determined by calculation. The line L10 is rotated at point P1 counterclockwise until it meets first with another point P5 on the embroidery pattern, and the point P5 is determined by calculation as a vertex (S31).

The line L11 passes through the previous point, which is the maximum point P1 determined at S30, and the current point, which is the point P5 determined at S31. The line L11 is rotated at point P5 counterclockwise until it meets first with another point P9 on the embroidery pattern, and the point P9 is determined by calculation (S32) as a vertex. If the current point P9 is not the maximum point P1 of the Y coordinate which is determined first (S33: No), the CPU 31 repeats the above steps S32 and S33. In the same manner as described above, points P13, P17, P20, P24, P28 are determined in sequence as vertexes. As a result, when point P1 that is found after P28 is determined, is the same as the maximum point P1 of the Y coordinates (S33: Yes), all vertexes P1, P5, P9, P13, P17, P20, P24, P28 are arrayed in the order of detection, and coordinates of vertexes Q1, Q2, Q3, . . . Qn to form an envelope polygon HT are determined (S34).

Figure 10:
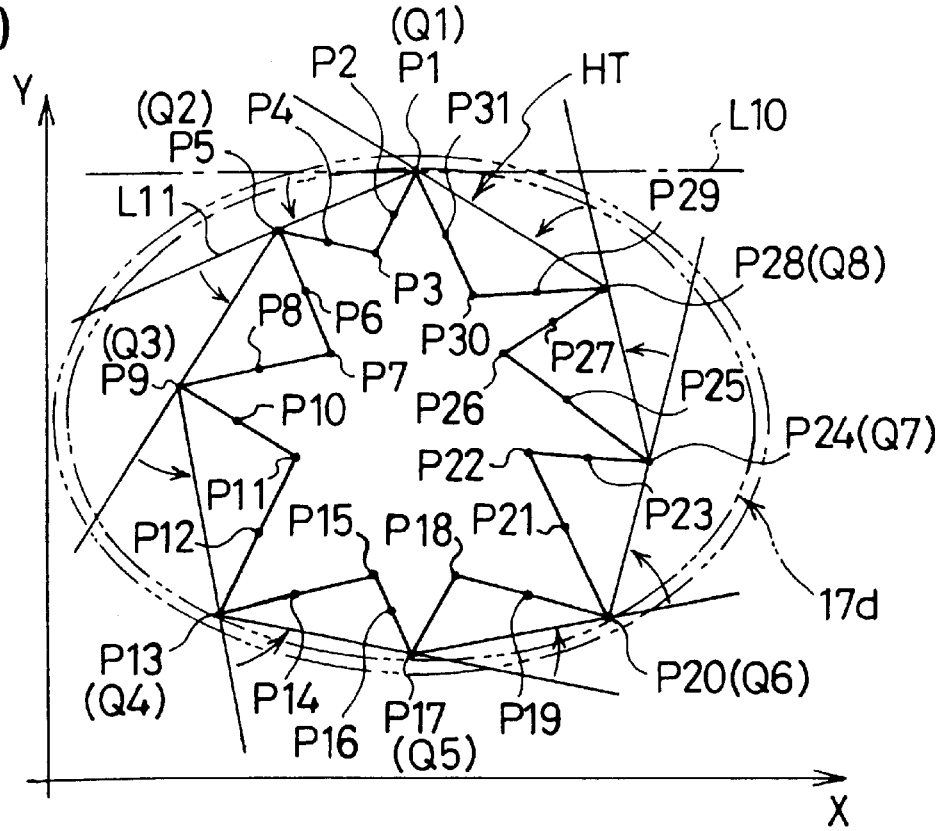
FIG. 10 describes how to find an envelope polygon area conforming to an embroidery pattern.

In FIG. 10, needle penetration points P1, P2, P3, . . . P31 are a small portion of all points on the embroidery pattern, and their coordinates are regarded as P1 (x1, y1), P2 (x2, y2), P3 (x3, y3), . . . P31 (x31, y31) respectively. So as to enable the needle 6 to trace the vertexes Q1, Q2, Q3, . . . Qn in this order based on their coordinate data, the drive signals are sent to the X-axis driving motor 16 and the Y-axis driving motor 13 respectively. The embroidery frame 17 is moved so that the needle 6 can relatively position on the points Q1, Q2, Q3, . . . Qn, and the trace operation is performed in the envelope polygon shape (S35). When the routine and the embroidery area trace routine are finished, the CPU 31 returns to the main routine.

As shown in FIG. 10, because the envelope polygon HT defined by vertexes Q1 to Q8 is traced within the embroidery frame 17*d*, the operator can be sure that the needle 6 will not hit the embroidery frame 17*d* during embroidering.

When the operator selects "4: circle" in the embroidery area trace routine (S2 to S4: No), a circle trace routine (FIG. 7) is executed (S8).

Figure 7:
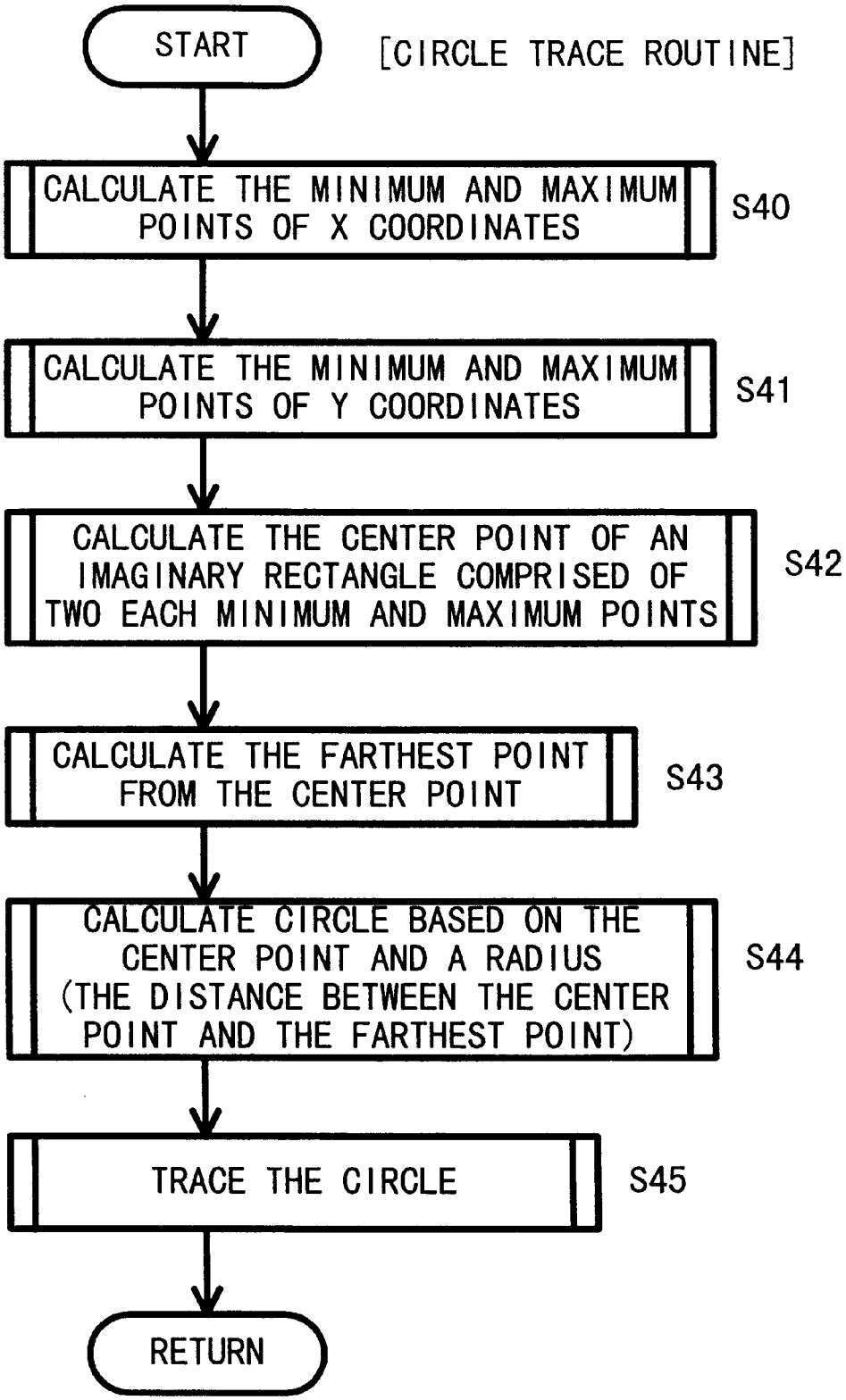
FIG. 7 is a flowchart of a circle trace routine.
Figure 11:
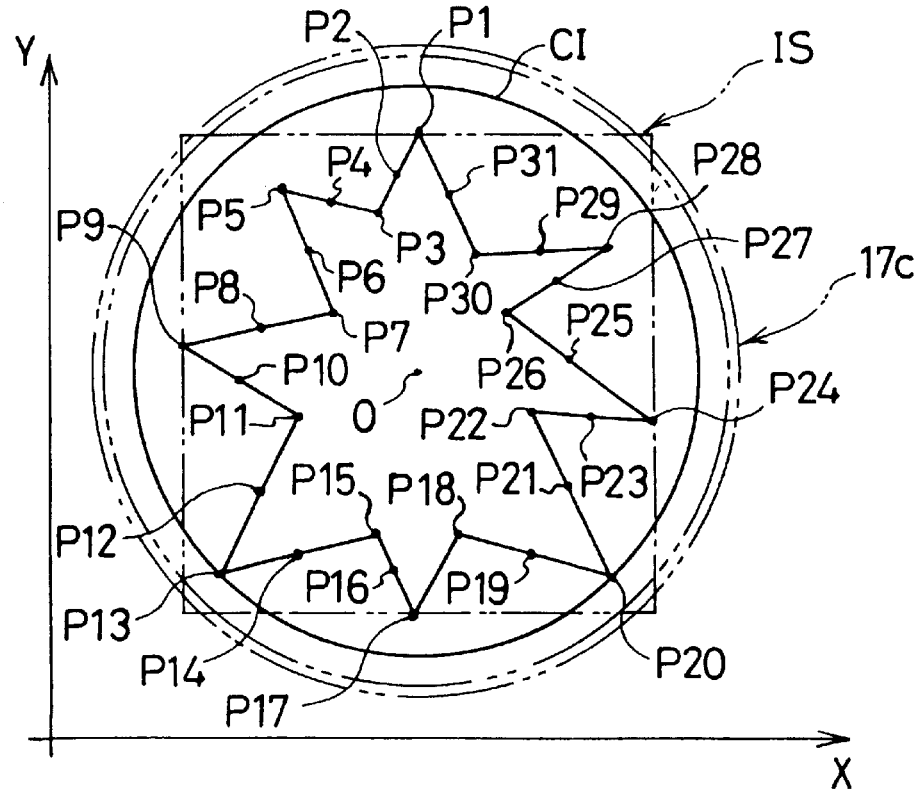
FIG. 11 describes how to find a circle area conforming to an embroidery pattern.

The circle trace routine will be now described with reference to FIGS. 7 and 11. In this routine, an embroidery area is determined in a circle so as to be close in size to an objective pattern. Firstly, in the X−Y coordinate system, the minimum point P9 (x9, y9) and the maximum point P24 (x24, y24) of the X coordinate are determined by calculation (S40). Then, the minimum point P17 (x17, y17) and the maximum point P1 (x1, y1) of the Y coordinates are determined by calculation (S41). A center point O of an imaginary rectangle IS, which is specified with the minimum points P9 and P17 and the maximum points P1 and P24, is determined by calculation (S42). The X coordinate of the center point O is found from formula "(x9+x24)/2", and the Y coordinate of it is from "(y1+y17)/2". Then, of needle penetration points P1, P2, P3, . . . Pn on the pattern, the point P13, the farthest from the center point O, is determined (S43). The distance between the center point O and the farthest point P13 is set as a radius and a circle CI is generated (S44).

So as to enable the needle 6 to draw a circular orbit based on the circle mask CI, the drive signals are sent to the X-axis driving motor 16 and the Y-axis driving motor 13. Then the embroidery frame 17 is moved so that the needle 6 can move on the circle CI, and a trace operation is performed in the circle shape (S45). When the routine and the embroidery area trace routine are finished, the CPU 31 returns to the main routine. Because the circle CI is traced within the embroidery frame 17*c*, as shown in FIG. 11, the operator can be sure the needle 6 will not hit the embroidery frame 17*c* during embroidering.

Summarizing, in the convex octagon trace, the convex octagon TK that circumscribes partial needle penetration points defining the outline of the embroidery pattern is found based on the minimum and maximum points on each of the X−Y coordinate system, the (X−Y) coordinate system, and the (X+Y) coordinate system. The convex octagon TK is one in which the four corners of a rectangle conventionally used are removed. Further, it circumscribes some of the needle penetration points defining the outline of the embroidery pattern. Therefore, the embroidery area to be traced can be checked more accurately because it is very close to the outline of the embroidery pattern. Even when the embroidery frame is oval or rectangle, the embroidery area with respect to the embroidery frame can be easily confirmed.

Moreover, the eight sides of the convex octagon TK are easily found from the four minimum points, the four maximum points, lines L1 to L4 that are parallel to the X- and Y-axes, and lines L5 to L8 having an inclination of 45 degrees in respect to the X-axis, as described above. Based on lines L1 to L8, the coordinate data for the eight vertexes Q1 to Q8 of the convex octagon TK can be easily found. This shortens the calculation time. In addition, the total length of the eight sides of the convex octagon TK is found to be shorter than that of four sides of a rectangle conventionally used. Therefore, this also shortens the time taken for trace operation in which the embroidery frame is moved relative to the needle and the time taken for confirmation of trace operation, improving the entire of trace operation.

In the envelope polygon trace, some of needle penetration points defining an outline of an embroidery pattern, are regarded as constituent vertexes to form the envelope polygon HT. Each of the constituent vertexes is found by rotating a line passing through the previous and current vertexes counterclockwise at the current vertex until it meets first with a needle penetration point on the outline, which becomes a constituent vertex, as described above. Therefore, the embroidery area to be traced can be checked more accurately because the envelope polygon HT is very close to the outline of the embroidery pattern. Even when the embroidery frame is oval or rectangle, the embroidery area with respect to the embroidery frame can be easily confirmed.

Only by finding the vertexes as described above, starting with turning a line that passes through the maximum point of the Y-axis coordinates counterclockwise, the formulas for finding each side of the envelope polygon HT circumscribing the outline of the embroidery pattern and the coordinates of the vertexes can be easily determined. Therefore, the time taken for calculation is shortened. In addition, the total length of the sides of the envelope polygon HT is found to be shorter than that of four sides of a conventional rectangle. Therefore, this shortens the time taken for the trace operation in which the embroidery frame is moved relative to the needle and the time taken for confirmation of the trace operation, improving the operation.

In the circle trace, the embroidery area for the trace operation is defined with the circle CI whose radius is regarded from the center point O of the imaginary rectangle IS circumscribing the outline of the embroidery pattern to the farthest point on the outline from the center point O. Therefore, the embroidery area to be traced can be checked more accurately because the circle CI is very close to the outline of the embroidery pattern. Even when the embroidery frame is circular, the embroidery area in respect to the embroidery frame 17*c* can be easily confirmed.

The circle CI substantially conforming to the outline of the embroidery pattern is easily defined with the distance between the center point and the farthest point. Accordingly, this shortens the calculation time. The circumference of a circle nearly conforming to the outline of the embroidery pattern is found to be shorter than the total length of four sides of a conventional rectangle. Therefore, this shortens the time taken for the trace operation in which the embroidery frame is moved relative to the needle and the time taken for confirmation of the trace operation, improving the operation.

Some modifications of the above embodiment will now be described.

In the convex octagon trace routine, a convex polygon in multiples of eight (integer), such as a convex polygon with 16 sides, can be calculated using any kind of graphic arithmetic logic.

In addition, it is also possible to create a convex polygon having multiples of eight sides, whose trace outline occupies minimal space. In such a case, the pattern is enclosed by a square, which encloses the minimum and maximum points of the embroidery pattern. A second square rotated 45 degrees is overlaid upon the first square to create a basic octagonal polygon. Commencing with a first vertex, a line of the first square is moved to contact the first vertex. A line laid upon the first line is then rotated to contact the next vertex, the rotation may be either clockwise or counterclockwise. The line of the second square, rotated 45 degrees to the first square, that is, in either the clockwise or counterclockwise position, is then moved in a parallel manner to contact the next vertex. A line parallel to the second line tangential to the second vertex is rotated in the same direction as was the first line to contact the next vertex. A second line from the first box, in either the clockwise or counterclockwise direction, is then moved in parallel to contact the vertex. This process is repeated until the entire embroidery pattern has been transcribed, and each side of the two boxes has been moved inwardly in a parallel manner to contact an identified vertex. The enclosed trace outline will have eight points in the example cited in which there are two squares, one rotated 45 degrees to the other box, but the space enclosed within the trace outline will be minimized.

In the envelope polygon trace routine, a plurality of vertexes comprised of an envelope polygon can be determined in sequence by regarding a needle penetration point that is met first or last with a straight line having an inclination when it is moved in parallel as a first vertex, and turning the line that passes through the vertex clockwise or counterclockwise at the vertex until it meets with the next needle penetration point (regarded as the next vertex) till the last vertex.

The sewing machine may further comprise a sensor for detecting the size and shape of the embroidery frame 17. Thus, the size and shape of the embroidery frame 17 attached to the front end of the X-axis moving arm 15 can be automatically detected, and the trace routine can be executed for a shape conforming to the size and shape of the detected embroidery frame 17.

Further, the embroidery machine may be designed to recognize the shape and size of an embroidery pattern based on the embroidery data for the embroidery pattern. Thus, an optimum trace shape, which is close to the embroidery pattern in terms of shape and size, such as a convex octagon or an envelope polygon, can be automatically decided.

The invention can be applied to every kind of embroidery machine having an embroidery frame and a movable frame, such as an embroidery machine with multiple heads.

Figure 12:
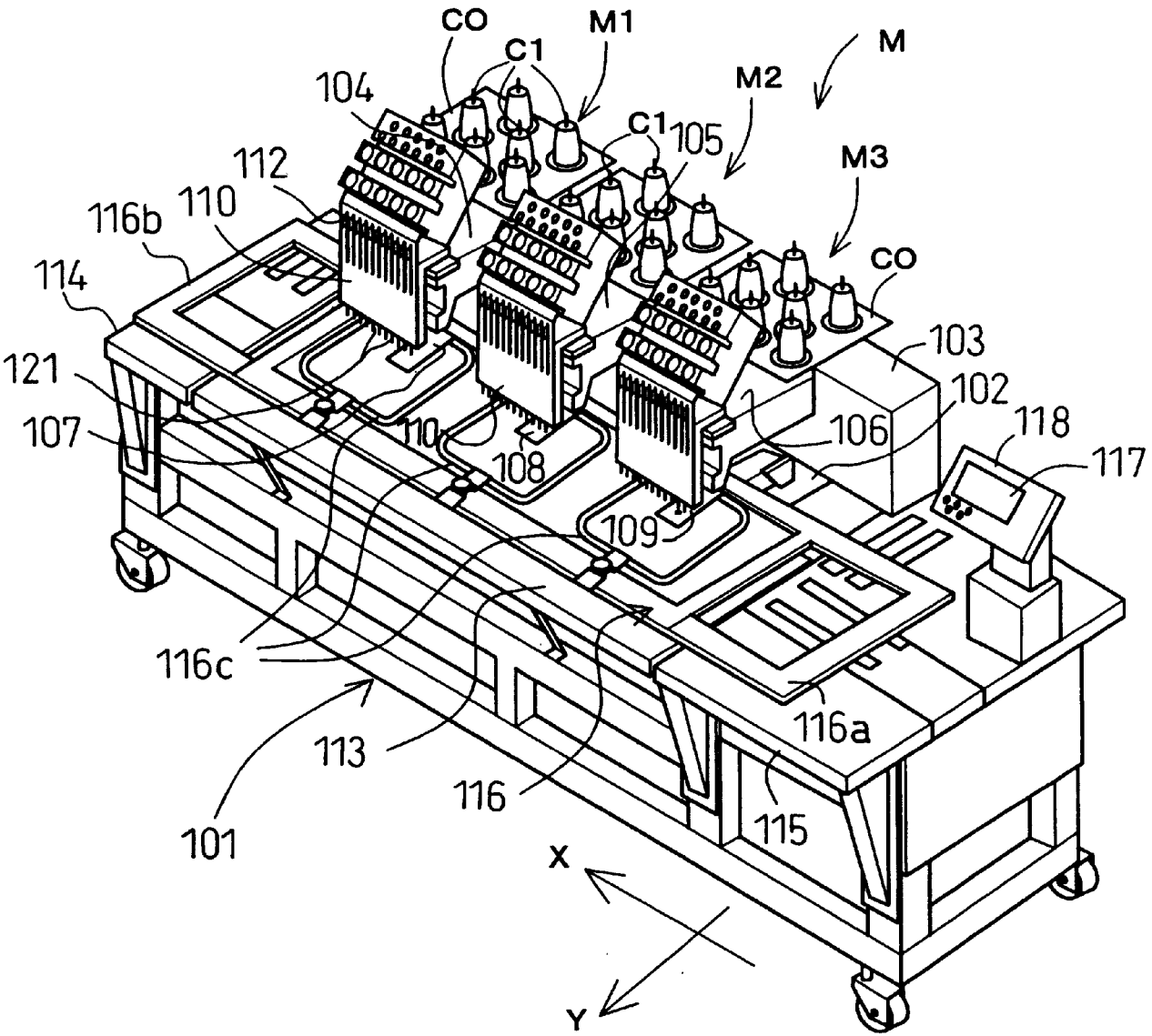
FIG. 12 is a perspective view of an embroidery machine with multiple heads according to a second embodiment of the invention.

Next, a second embodiment of the invention will be described in detail with reference to the accompanying drawings. FIG. 12 shows an appearance of an embroidery machine with multiple heads M in a perspective view, in which three embroidery machines M1, M2, and M3 are arrayed.

The embroidery machine M includes a laterally extending base frame 101, a machine supporting stand 102 which is secured on the rear of the base frame 101, and a laterally extending supporting frame 103 which is disposed at a rear portion of the machine supporting stand 102 and arranged lengthwise in a standing position.

The base frame 101 provides three machine head portions 104, 105, and 106 thereon. The head portions 104 to 106 have respective cylindrical bed portions 107, 108, and 109 thereunder. Thus, three embroidery machines M1, M2, M3 comprise the head portions 104, 105, 106 and the bed portions 107, 108, 109, respectively.

A needle bar case 110 which is laterally movable is attached to the front of each of the head portions 104 to 106. In each needle bar case 110, twelve needle bars 121, which are arranged in a row right to left, are supported so that they can be moved up and down, and corresponding twelve thread take-ups 112 are also pivotally supported.

The needle bar cases 110 are concurrently moved laterally by their respective needle bar changing mechanisms (not shown) each changing a needle bar to be used, so that a different color of needle thread can be used.

At the front of the machine supporting stand 102, a work table 113 is horizontally disposed on a level with bed portions 107 to 109. A pair of auxiliary tables 114 and 115 are disposed on each side of the work table 113. A movable frame 116 having a rectangular shape and extending laterally is placed on the work table 113, and the auxiliary tables 114 and 115.

The movable frame 116 is moved via a right frame **116*a* and a left frame 116*b* both which are moved in an X direction (right and left in FIG. 12) by an X-axis driving mechanism (not shown), and in a Y direction (back and forward in FIG. 12**) by a Y-axis driving mechanism (not shown).

A plurality of embroidery frames 116c corresponding to embroidery machines M1 to M3 are attached to the movable frame 116. As the movable frame 116 is moved on an X–Y coordinate system plane by the X- and Y-axis driving mechanisms, the embroidery frames **116*c*** are also movable in the X and Y directions.

A plurality of spools C1 are rotatably placed on a spool stand C0 attached to the upper part of the machine supporting stand 102. A needle thread C2 supplied from the spool C1 is threaded to a needle bar 121 described later via associated parts including the corresponding thread take-up 112. At the rear of the auxiliary table 115, there is provided an operation panel 118 having a plurality of switches (not shown) and a liquid crystal display 117 for displaying various messages related to the embroidering.

Figure 13:
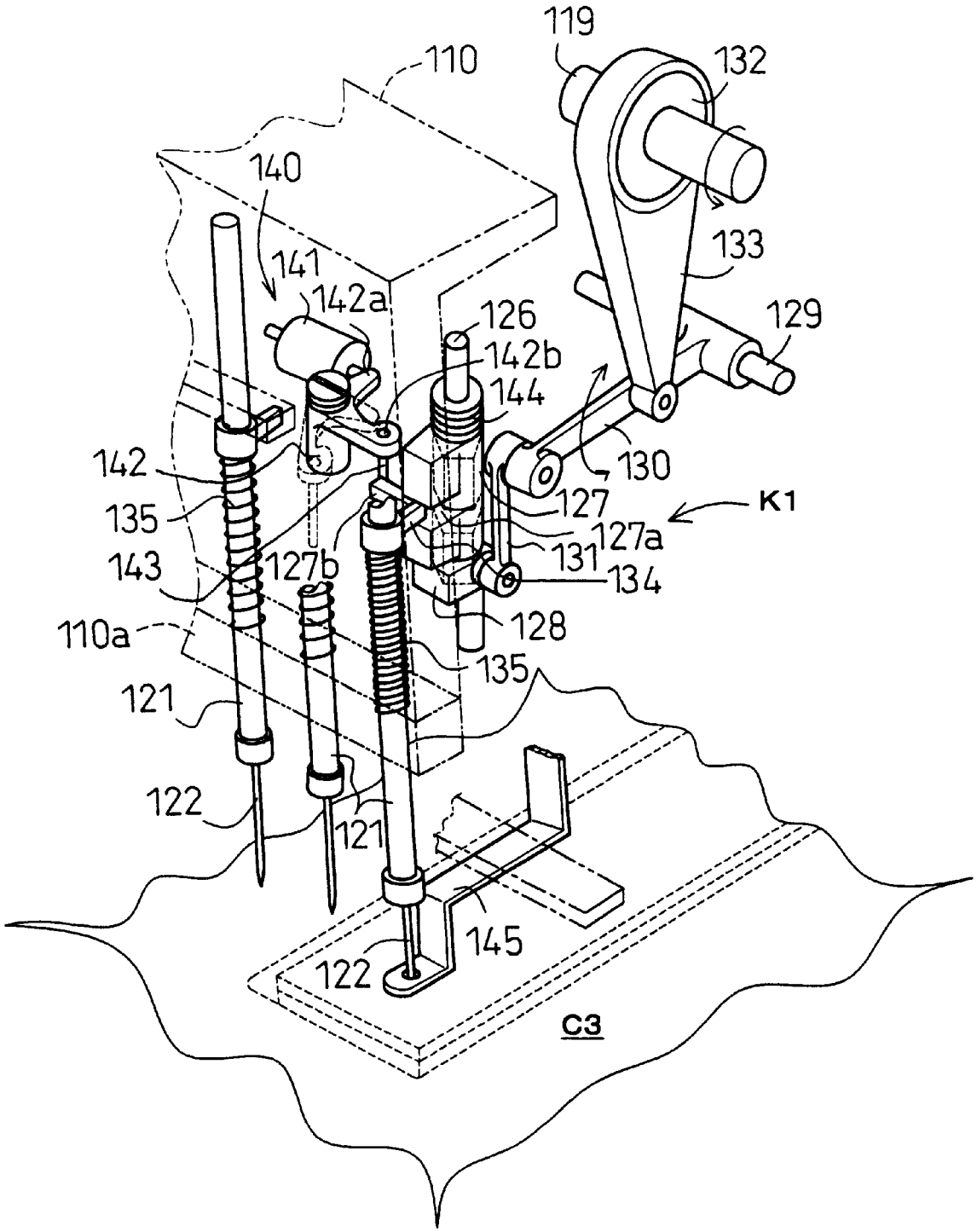
FIG. 13 shows a plurality of needle bars and a needle bar driving mechanism in the machine in an enlarged perspective view.

Next, a needle bar up and down moving mechanism K1 that is provided for each of embroidery machines M1 to M3 will now be described briefly with reference to FIG. 13. A more detailed description can be found in U.S. patent application Ser. No. 09/275,051, filed Mar. 24, 1999, the disclosure of which is incorporated herein by reference. FIG. 13 shows the needle bars 121 and the needle bar up and down moving mechanism K1 in an enlarged view. The mechanism K1 moves a needle bar 121 vertically in time with operation of a machine main shaft 119. Accordingly, the needle 122 attached to the bottom of the needle bar 121 is moved vertically.

At the rear of the needle bar case 110, the machine main shaft 119 is disposed laterally through the head portions 104 to 106. The machine main shaft 119 passes through an eccentric cam 132. The eccentric cam 132 is fitted in an eccentric lever 133, which is linked to a rocking lever 130.

A master needle bar 126 extending vertically is disposed at the front edge of each of the head portions 104 to 106. The master needle bar 126 is supported to a frame inside the needle bar case 110 at its upper and lower ends. A vertically movable segment 127 is movably fitted around the master needle bar 126. The movable segment 127 has a groove 127a engageable with a linking pin 134 described later. A needle bar connecting stud 128, which is disposed under the movable segment 127, is attached to a link 131 which is attached to the rocking lever 130, which is movably pivoted by a pivot shaft 129.

A compression spring 135 is fitted around the needle bar 121 and interposed between the linking pin 134 and the supporting frame **110*a* of the needle bar case 110. The needle bar 121 is always urged by the spring 135** to its upper needle stop position.

When the needle bar case 110 is moved in the lateral direction, the pin 134 attached to the needle bar 121 corresponding to the movable segment 127 is selectively fitted into the groove 127*a*.

Figure 17:
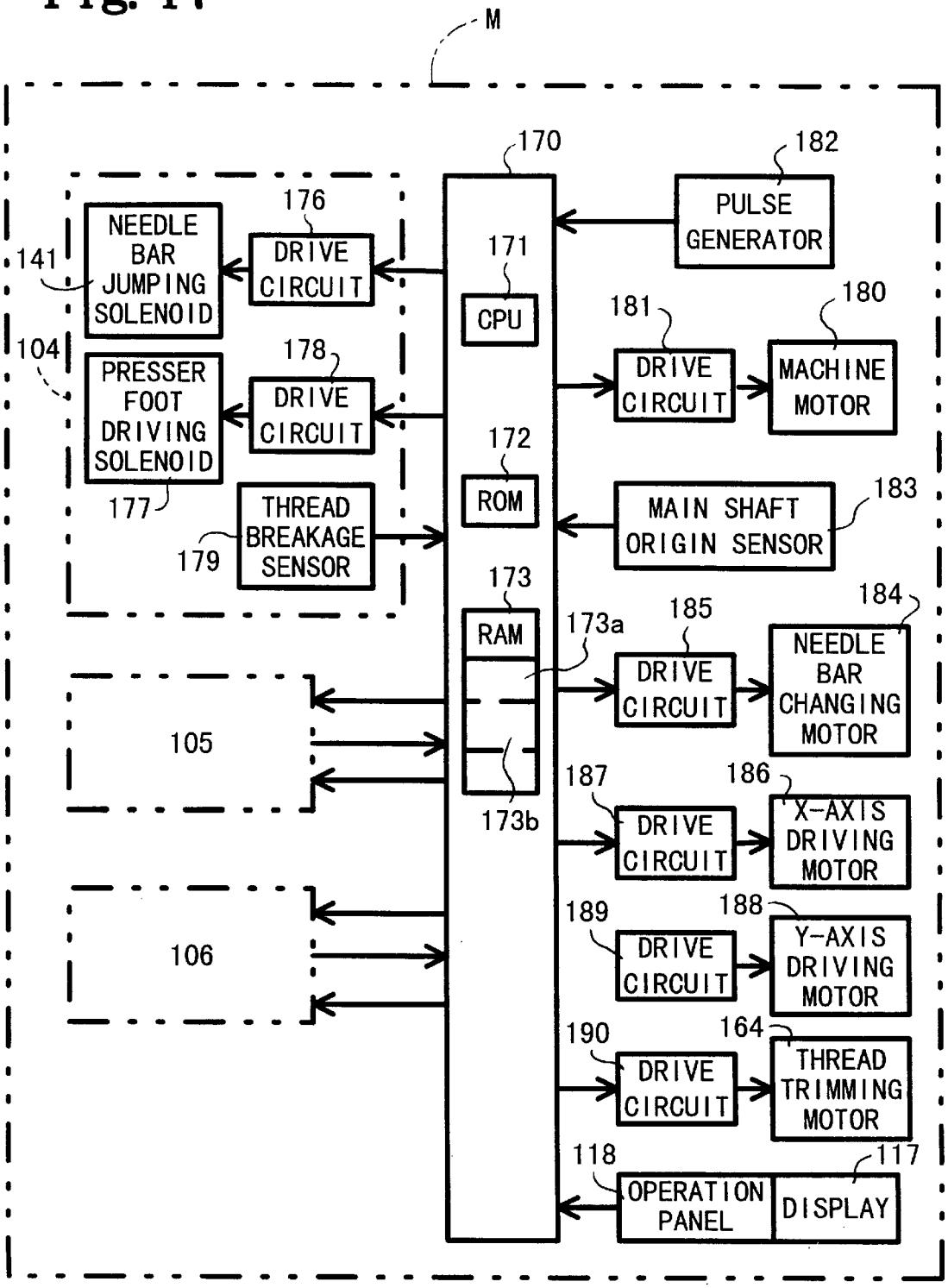
FIG. 17 is a block diagram showing a control system of the machine.

With this arrangement, upon rotation of a machine motor 180, FIG. 17, in a predetermined rotational direction, the machine main shaft 119 is rotated about its axis, so that the movable segment 127 and the needle bar connecting stud 128 are integrally reciprocally moved in the vertical direction by way of the eccentric lever 133, the rocking lever 130, and the link 131. As a result, only the needle bar 121 engaged with the movable segment 127 through the pin 134 is vertically reciprocally moved in a timed relation with the rotation of the machine main shaft 119.

A needle bar jumping mechanism 140 provided for each of embroidery machines M1 to M3 will now be described with reference to FIG. 13. The needle bar jumping mechanism 140 jumps the needle bar 121 to its highest position or top end point to change the needle bar 121 to be engaged with the movable segment 127.

Mounted inside the needle bar case 110 is a needle bar jumping solenoid 141 which is in a horizontal position, and a rotating lever 142, which is substantially L-shaped when viewed from the top, and is pivotable about a vertical axis.

A driving part 142*a* of the rotating lever 142 makes contact with a plunger of the solenoid 141, and an operation shaft 143, which is vertically attached to a driven part 142*b*, is engageable with an engaging member 127*b* which is projected from the vertically movable segment 127.

The vertically movable segment 127 is rotated between its linking position (regular position) indicated by a solid line and its jump position where the segment 127 is rotated for a fixed angle counterclockwise from the regular position. A coil spring 144, which is disposed at an upper position of the segment 127, normally urges the segment 127 so as to rotatably move from the jump position to the regular position.

When the needle bar 121 is linked to the vertically movable segment 127 via the pin 134, the needle bar jumping solenoid 141 is driven for a predetermined time, and its plunger is moved into the right. The rotating lever 142 is rotated clockwise when viewed from the top, and the vertically movable segment 127 is concurrently rotated to the jump position via the shaft 143 and the engaging member 127*b*. Consequently, the pin 134 is disengaged from the groove 127*a*. At this time, the needle bar 121 is urged by the compression spring 135 to promptly move to the highest position (perform the jumping operation).

On the other hand, when the needle bar 121 is in the jump condition to its highest position and the vertically movable segment 127 has returned to the regular position and rises from the down to its highest position, the segment 127 makes contact with the pin 134 from the bottom. At this time, the segment 127 is rotated temporarily to the jump position, and is urged by the coil spring 144 immediately to return to the regular position. Therefore, the pin 134 is automatically fitted into the groove 127*a*.

Each of the bed portions 107 to 109 is provided with a presser foot 145 that is driven by a presser foot driving mechanism, not shown. The position of the presser foot 145 can be changed between a pressing position where the presser foot 145 presses a work cloth C3 on the associated bed portion and a retracting position positioned above the pressing position by a predetermined distance.

Figure 14:
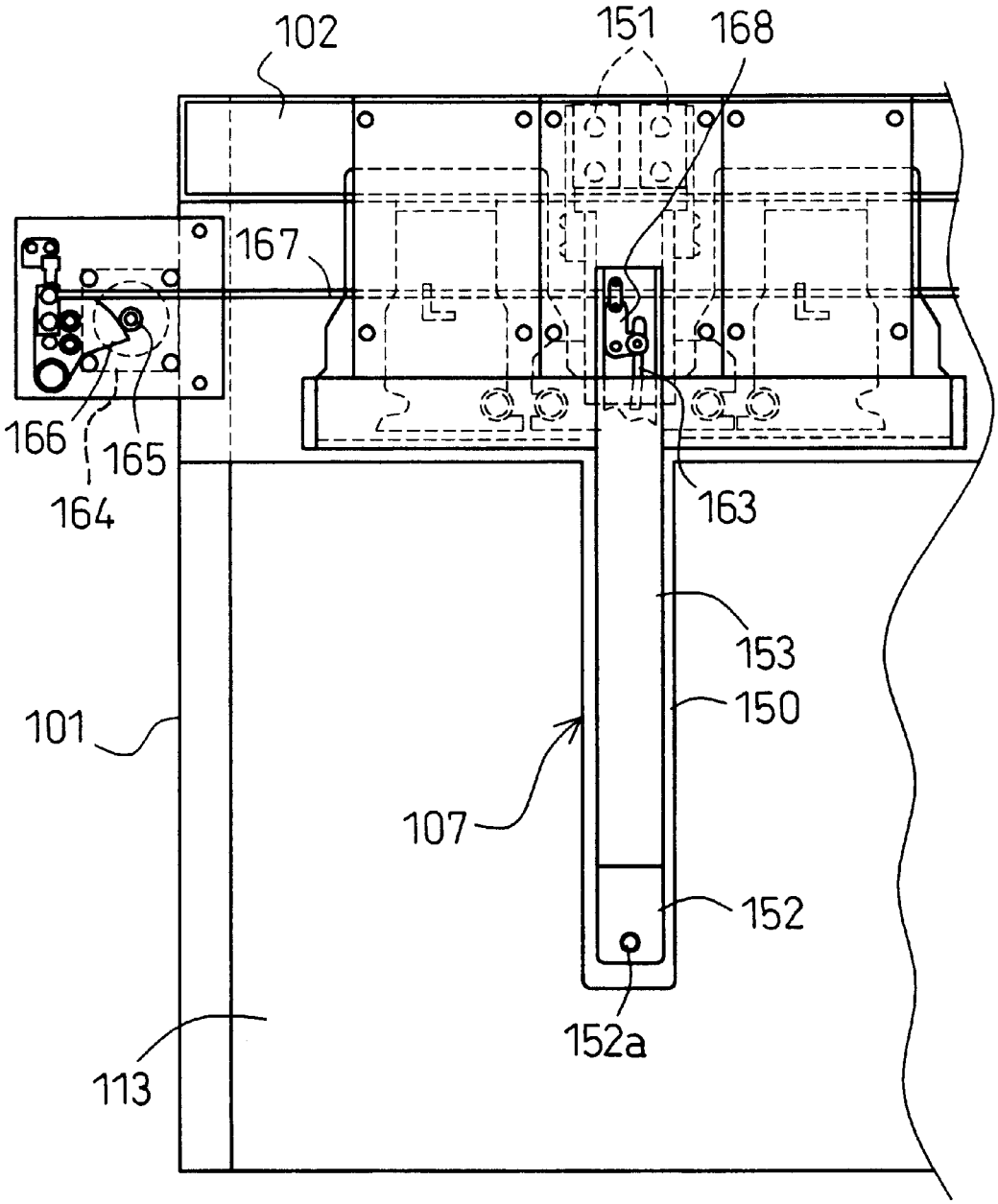
FIG. 14 is a plan view showing a base frame of the machine.
Figure 15:
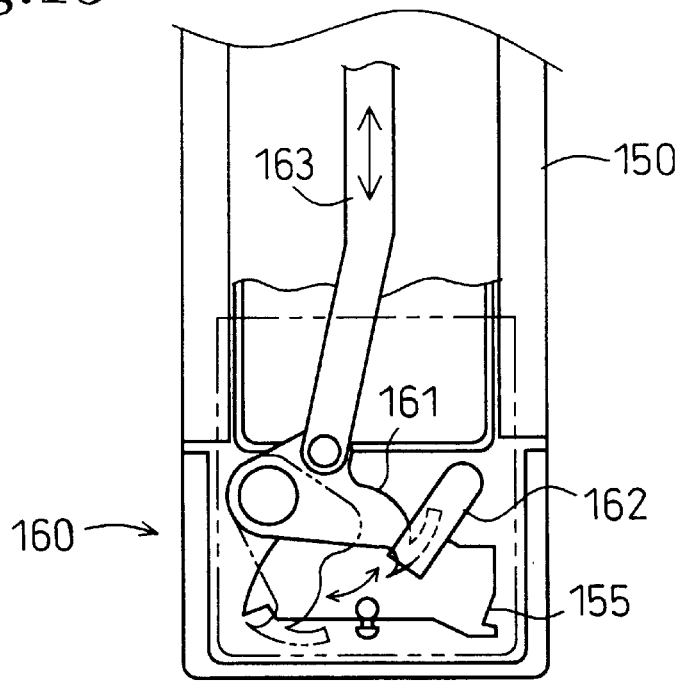
FIG. 15 shows a front end of the base frame in an enlarged plan view.
Figure 16:
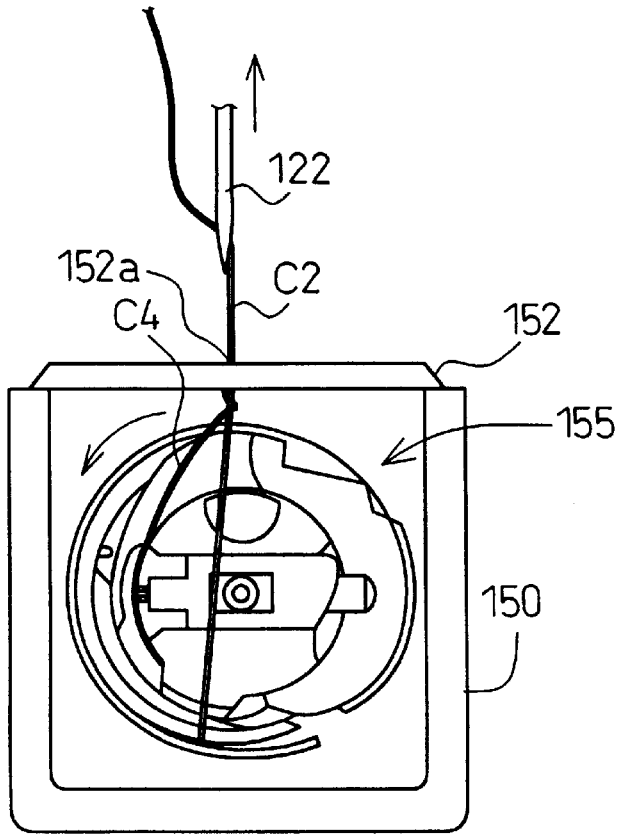
FIG. 16 is an enlarged plan view showing a rotary hook provided in the machine.

The bed portions 107 to 109 will now be described with reference to FIGS. 14 to 16. FIG. 14 is an enlarged top view of the work table of the embroidery machine M. FIG. 15 shows the end of the base frame 101 of the machine M in an enlarged top view. FIG. 16 is an enlarged front view of a rotary hook 155 disposed in the base frame 101. A bed case 150, which is substantially U-shaped in a sectional view, extends front to back. Its rear end is attached to a pair of supporting brackets 151, which is secured to the base frame 101. The rotary hook 155 for catching loops is provided at the front end of the bed case 150. Receiving the rotation of a hook shaft, the rotary hook 155 rotates in synch with the machine main shaft 119. The bed case 150 is covered with a needle plate 152 at its front end and, to the rear, with a cover plate 153 that is connected to the needle plate 152. The needle plate 152 has a needle hole 152*a*.

A thread trimming mechanism 160 provided for each of the bed portions 107 to 109 will now be described with reference to FIGS. 14 to 16. The thread trimming mechanism 160 cuts a needle thread C2 shown in FIG. 16 and a bobbin thread C4 when the needle thread C2 is changed or the needle thread C2 and the bobbin thread C4 are cut from a work cloth after embroidering.

Under the needle plate 152, a movable knife 161 is pivotally supported so that it can oscillate between a standby position indicated by a solid line in FIG. 15 and a maximum pivot position indicated by a double dashed chain line. A fixed knife 162, that cooperates with the movable knife 161 to cut the needle thread C2 and the bobbin thread C4, is mounted opposite to the movable knife 161 under the needle plate 152.

A thread trimming operation lever 163 is connected to the movable knife 161 and extends backward in the bed case 150. When a thread trimming motor 164, which is disposed on the left end of the base frame 101 as shown in FIG. 14, is started, the motion is transmitted through a driving gear 165 and a fan-shaped oscillating member 166 to a thread trimming operation shaft 167. The thread trimming operation shaft 167 is moved right and left, and accordingly the thread trimming operating lever 163 is moved back and forth. Thus, the lever 163 is driven, allowing the movable knife 161 to oscillate toward the fixed knife 162 to cut the needle thread C2 and the bobbin thread C4 at the same time.

A controller 170 of the machine M will be now described with reference to FIG. 17. FIG. 17 is a block diagram of a control system described in the embodiment.

The machine M comprises the operation panel 118 with the LCD display 117, a drive circuit 181 for driving the machine motor 180, a drive circuit 187 for driving an X-axis driving motor 186, a drive circuit 189 for driving a Y-axis driving motor 188, a drive circuit 185 for driving a needle bar changing motor 184 that allows the needle bar case 110 to change a needle bar, and a drive circuit 190 for driving the thread trimming motor 164. The drive circuits 181, 185, 187, 189, 190 are connected to the controller 170. The controller 170 comprises a CPU 171, a ROM 172, and a RAM 173 which are connected to an input/output interface, not shown, via a data bus.

The ROM 172 stores a plurality of embroidery data for each embroidery pattern, a control program for embroidering formed by driving the Y-axis driving motor 188 and the X-axis driving motor 186 based on the embroidery data, and data required for trace mode control, which will be described later.

The RAM 173 provides a variety of memory areas including a work area 173*a* which is necessary for embroidering, and a temporary storage area 173*b* for a result of movement amount of the movable frame 116 calculated by the CPU 31. Data stored in the memory areas 173*a* and 173*b* are taken out by the CPU 171 at any time to use for embroidery operations and trace operations.

As to the head portion 104, there are provided a drive circuit 176 for driving the solenoid 141 for the needle bar jump mechanism 140 disposed in the needle bar case 110, a drive circuit 178 for a presser foot driving solenoid 177 that moves the presser foot 145 to the retracted position, and a thread breakage sensor 179. The drive circuits 176, 178 and the thread breakage sensor 179 are connected to the controller 170. As with the head portion 104, the same is true of the head portions 105 and 106.

The thread breakage sensor 179 detects when needle thread C2 has been broken. Specifically, an encoder disk (not shown), disposed through the path to the needle thread C2, is pivotally mounted on the frame inside of the needle bar case 110. The needle thread C2 is wound around a rotating part of the encoder disk, and the thread breakage sensor 179 is disposed facing the encoder disk. Therefore, the sensor 179 outputs encoder signals via the encoder disk rotating in time with the needle thread C2 paid out every embroidering cycle. The encoder signals are continuously inputted to the CPU 171 until the needle thread is broken.

The controller 170 is connected to a pulse generator 182, a main shaft origin sensor 183, and the operation panel 118 having the LCD display 117. The pulse generator 182 outputs an encoder signal comprised of 1000 pulse signals made in one turn of an encoder disk disposed at the machine main shaft 119. The origin sensor 183 outputs a synchronization signal in one turn of the encoder disk.

The ROM 172 stores therein control programs for controlling the motors 164, 180, 184, 188 based on the encoder signal issued from the pulse generator 182 and the synchronization signal from the origin sensor 183, and the execution programs used in trace modes described later, including programs enabling the reverse trace, change of the trace speed, and suspension of trace.

Figure 18:
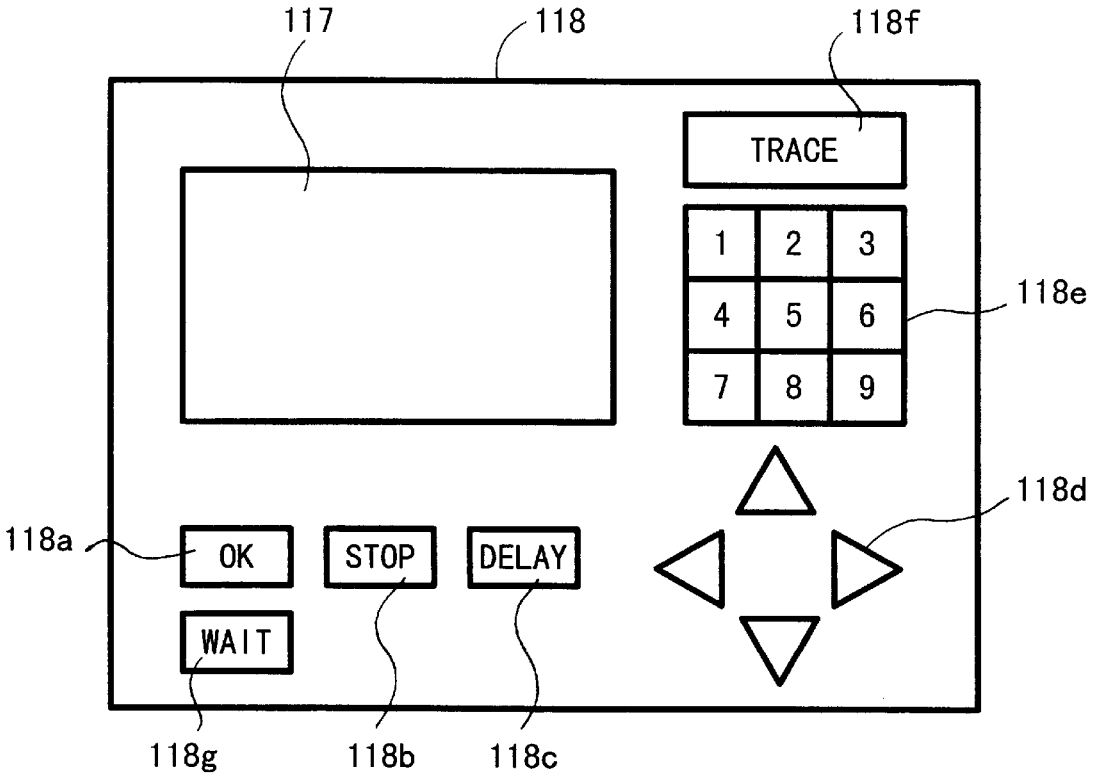
FIG. 18 is an enlarged plan view showing an operation panel.

Next, the operation panel 118 will be now described. FIG. 18 shows the operation panel 118 in an enlarged plan view. The operation panel 118 has an OK key 118*a*, a STOP key 118*b* for suspending the trace operation, a DELAY key 118*c* for delaying the trace speed temporarily, four direction arrow keys 118*d* for selecting the trace speed and direction, a number key pad 118*e* for selecting the stop position in the trace, a TRACE key 118*f* for performing the trace operation, and a WAIT key 118*g* for changing a wait time. These keys are just exemplary. Operations can be selected using other input media, such as a mouse.

The needle bar changing motor 184 moves the needle bar cases 110 of the embroidery machines M1 to M3 right and left, to select a needle bar 121 to be used for embroidering. Therefore, the selected needle bar 121 on each machine is always at the same position. In other words, the position of the movable frame 116 on the X–Y coordinate system determines the relative position between the embroidery frame 116*c* and the needle 122 for each of the machines M1 to M3. The X-axis driving motor 186 and the Y-axis driving motor 188 are pulse motors, therefore the movable frame 116 is moved approx. 0.1 mm every pulse applied to the motors 186, 188. In other words, the embroidery frames 116*c* are moved approx. 0.1 mm in the X-or Y-axis direction every pulse, in relation to the corresponding needle 122.

Actually in the trace mode, the needle 122 moves in no direction, and the embroidery frame 116*c* moves in four directions in relation to the needle 122. For convenience, however, the description will be provided under the assumption that the embroidery frame 116*c* is stopped and the needle 122 moves in four directions in relation to the embroidery frame 116*c* in the embodiment.

Figure 19:
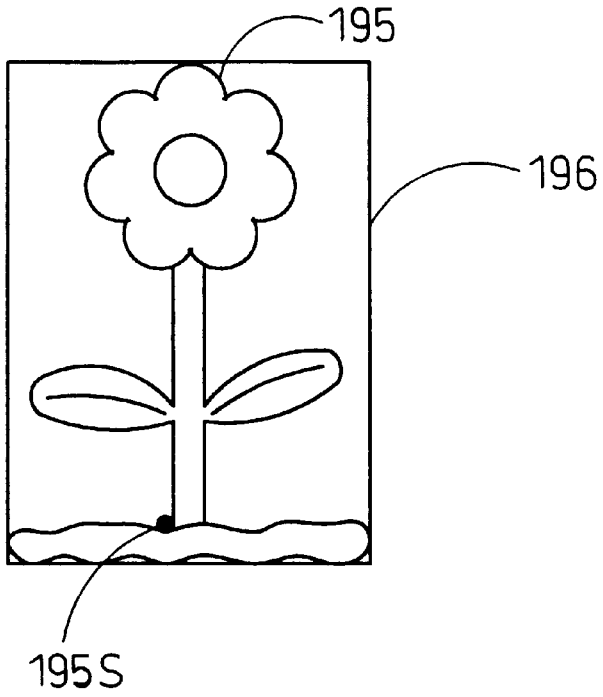
FIG. 19 shows an example of a pattern to be embroidered on the machine.
Figure 20:
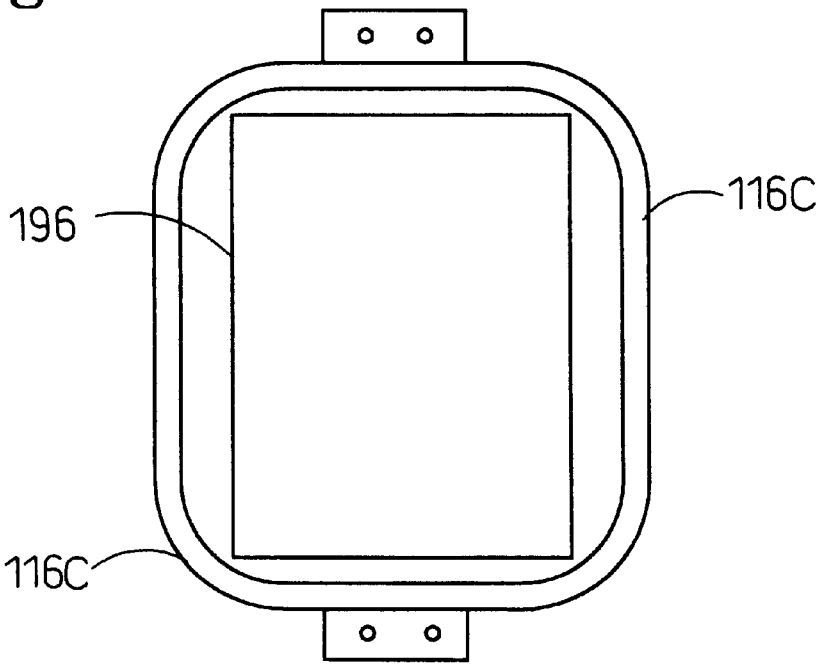
FIG. 20 shows an embroidery frame in an enlarged view.
Figure 21:
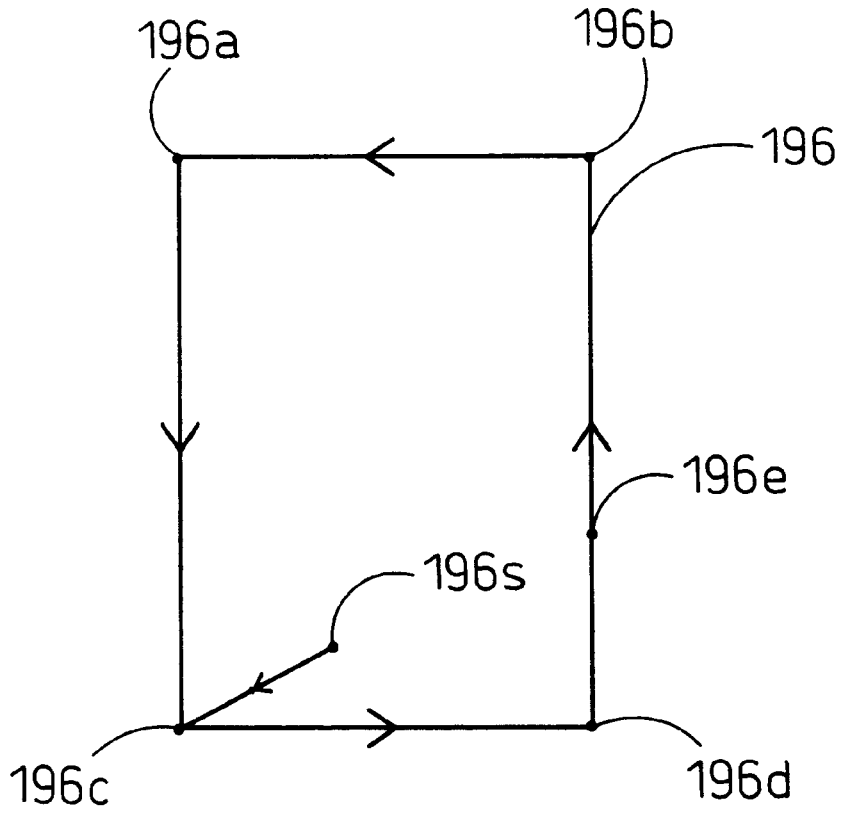
FIG. 21 shows a sequence of trace operation.

Next, the relationship between the embroidery frame 116*c* and a mask data 196 will be now described. The mask data 196 represents a mask where the mask identifies the size, shape, and location of a pattern. In the embodiment, a trace operation is performed using the mask data. Therefore, the mask data in this embodiment is equal to the trace shape in the first embodiment. FIG. 19 shows an example of a pattern 195 to be embroidered by the machine M. FIG. 20 is an explanatory drawing indicating a perfect placement of the embroidery frame 116*c* and the mask data 196 for the pattern 195 to be embroidered by the machine M. FIG. 21 shows a sequence of trace operation.

When the pattern 195, shown in FIG. 19, is embroidered using the embroidery frame 116*c*, shown in FIG. 20, the machine M confirms whether the pattern 195 is completely within the embroidery frame 116*c* before actual embroidering. This is because the needle 122 may come into contact with the frame 116*c*, or the needle 122 may be broken in a worse case, if embroidering is started when the pattern 195 is not fully enclosed within the frame 116*c*.

As shown in FIG. 20, the embroidery frame 116*c*, which is rectangular, and the mask data 196, which is also rectangular, is large enough to cover the pattern 195 shown in FIG. 19, completely. When the CPU 31 goes into a trace mode where a trace operation is performed in the order, as shown in FIG. 21, with the needle 122 at its highest position, the operator checks whether the trace of the needle 122 is done within the embroidery frame 116*c*, checking the relative position between the needle 122 and the embroidery frame 116*c*.

When the pattern 195 is embroidered from a starting point 195*s*, a trace starting point 196*s*, shown in FIG. 21, corresponds to the starting point 195*s*. The trace is normally performed in the order starting from the point 196*s* through points 196*c*, 196*d*, 196*b*, 196*a*, ending at the point 196*c*. For a reverse trace, the order is 196*s*, 196*c*, 196*a*, 196*b*, 196*d*, and 196*c*, in the opposite direction of normal trace. The points 196*a*, 196*b*, 196*c*, and 196*d* are at the corners of the mask data. It may be desirable to slow down the trace speed or make a stop at points placed on the corners because the direction of the trace changes at these points.

Trace operation of the machine M will be now described with reference to FIGS. 22 to 28. The machines M1 to M3 are identical with one another, therefore a description will be provided with respect to one machine M1 and under the assumption that the preparations are all made, such as reading the mask data 196, setting the work cloth C3 in the embroidery frame 116*c*, and specifying the trace start point 196*s*.

When the operator presses the TRACE key 118*f* on the operation panel 118, the LCD display 117 indicates three alternative options of "all corners slowdown", "next corner stop", and "specified corner stop". The operator can select an option by touching on it on the display 117, and then a trace mode which enables the selected option is set.

Figure 22:
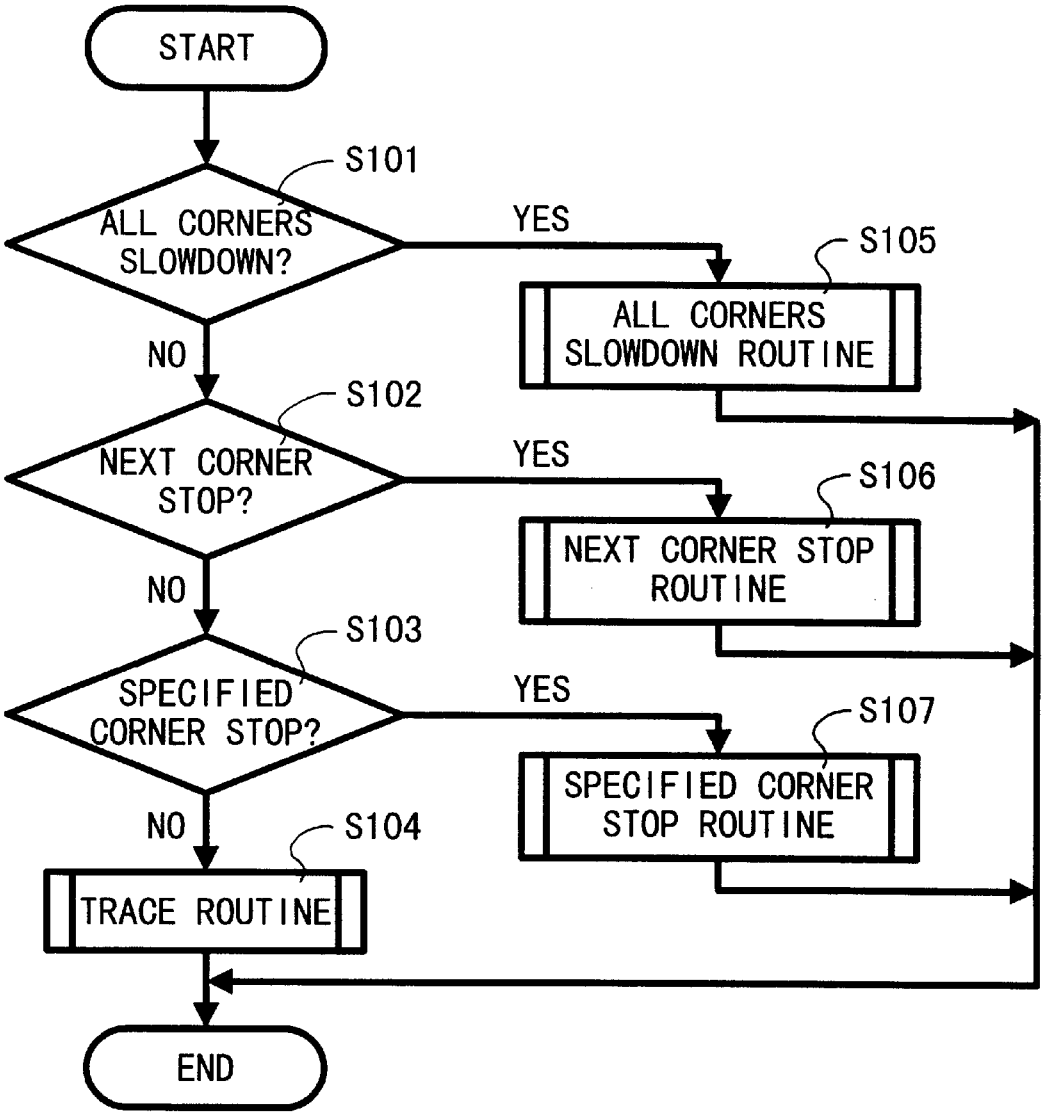
FIG. 22 is a flow chart showing a trace mode selection routine.
Figure 23:
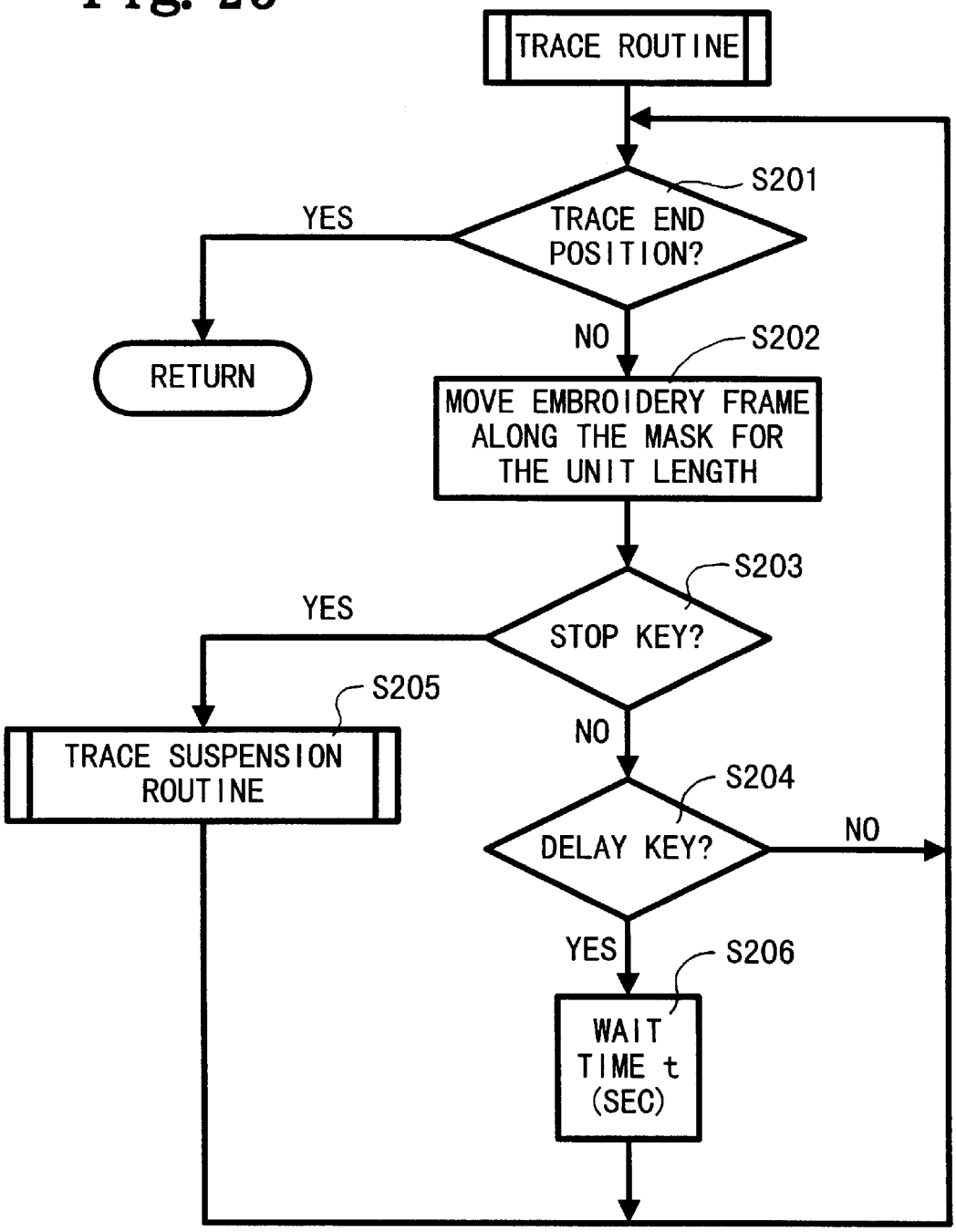
FIG. 23 is a flowchart showing a trace routine.
Figure 24:
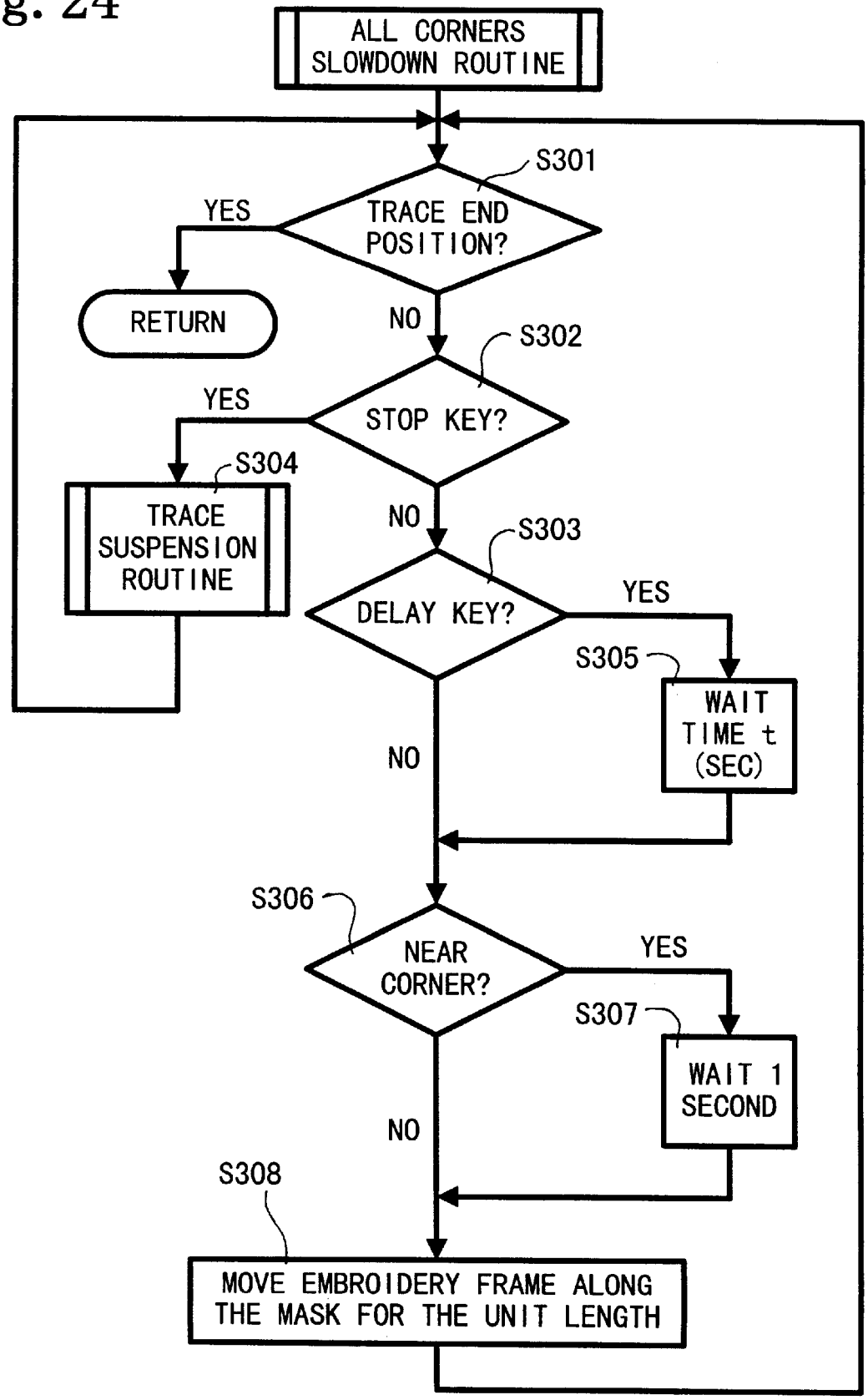
FIG. 24 is a flowchart showing an all corners slowdown routine in which the trace is temporarily stopped at all corners of a mask data.
Figure 25:
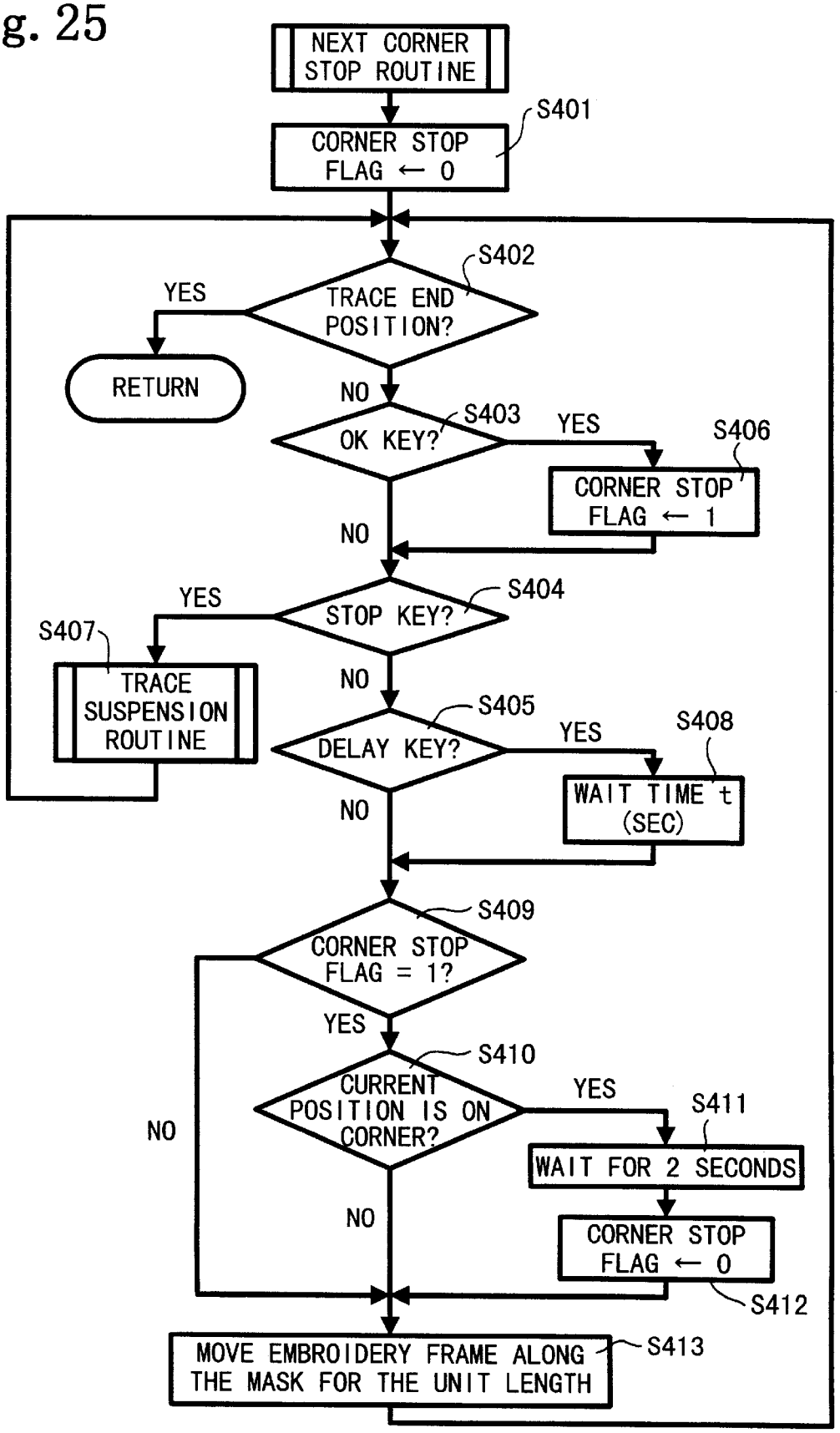
FIG. 25 is a flowchart showing a next corner stop routine in which the trace is temporarily stopped at a corner next to a position where the operator has pressed the "OK" key.
Figure 26:
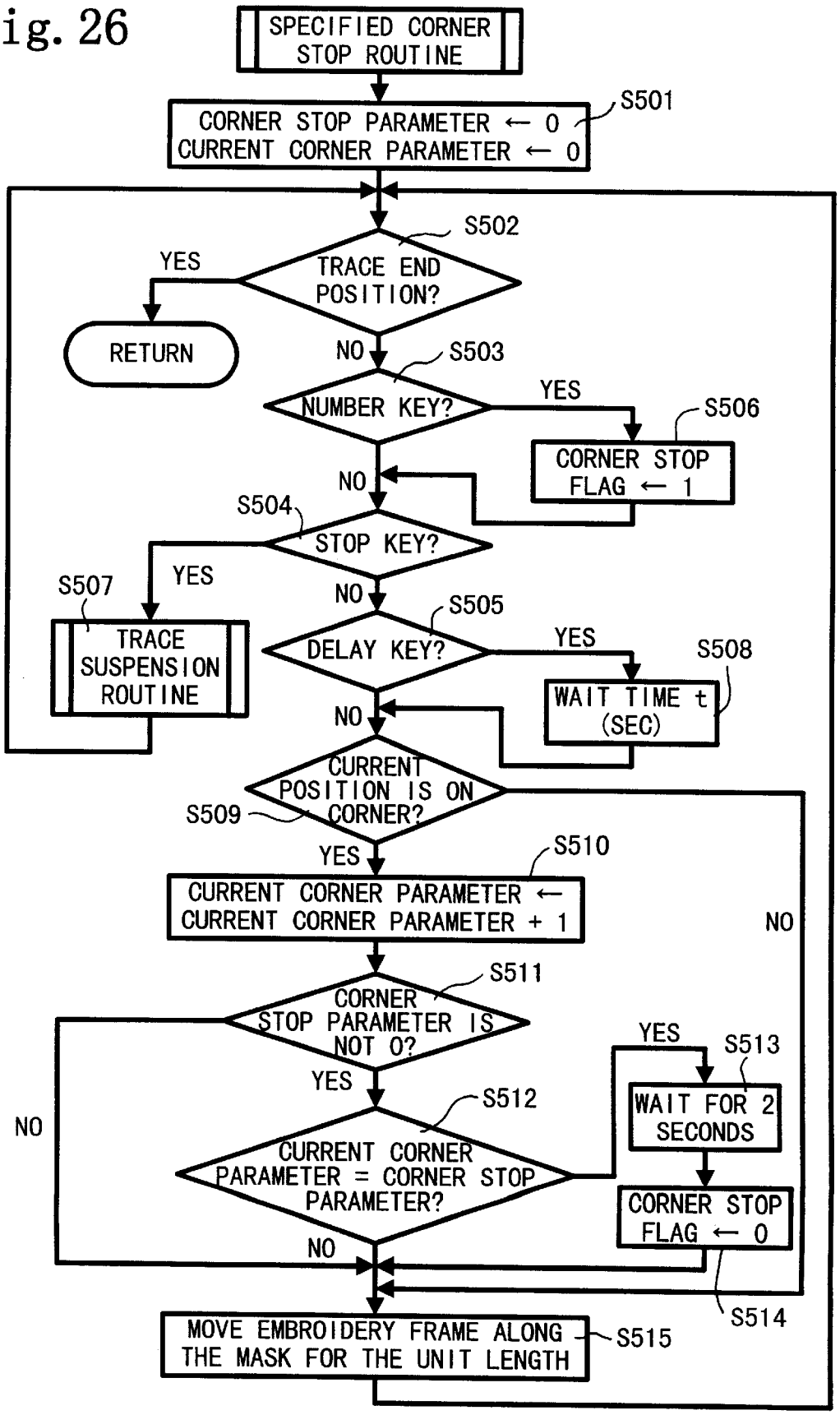
FIG. 26 is a flowchart showing a specified corner stop routine in which the trace is temporarily stopped at a corner previously specified by number.

FIG. 22 is a flowchart illustrating steps of selecting a trace mode to be executed by the machine M. In each flowchart, Si (i=1, 2, 3 . . . ) stands for a procedure step. FIG. 23 shows a basic trace routine executed when no option is selected. FIG. 24 is a flowchart for a trace routine in which the trace is temporarily stopped at all corners of a mask data (S105 of FIG. 22). FIG. 25 is a flowchart for the trace routine in which the trace is temporarily stopped at a corner next to a position where the operator has pressed the "OK" key during a trace operation of a mask data (S106 of FIG. 22). FIG. 26 is a flowchart for a trace routine in which the trace is temporarily stopped at a corner previously specified by number of a mask data (S107 of FIG. 22).

Figure 27:
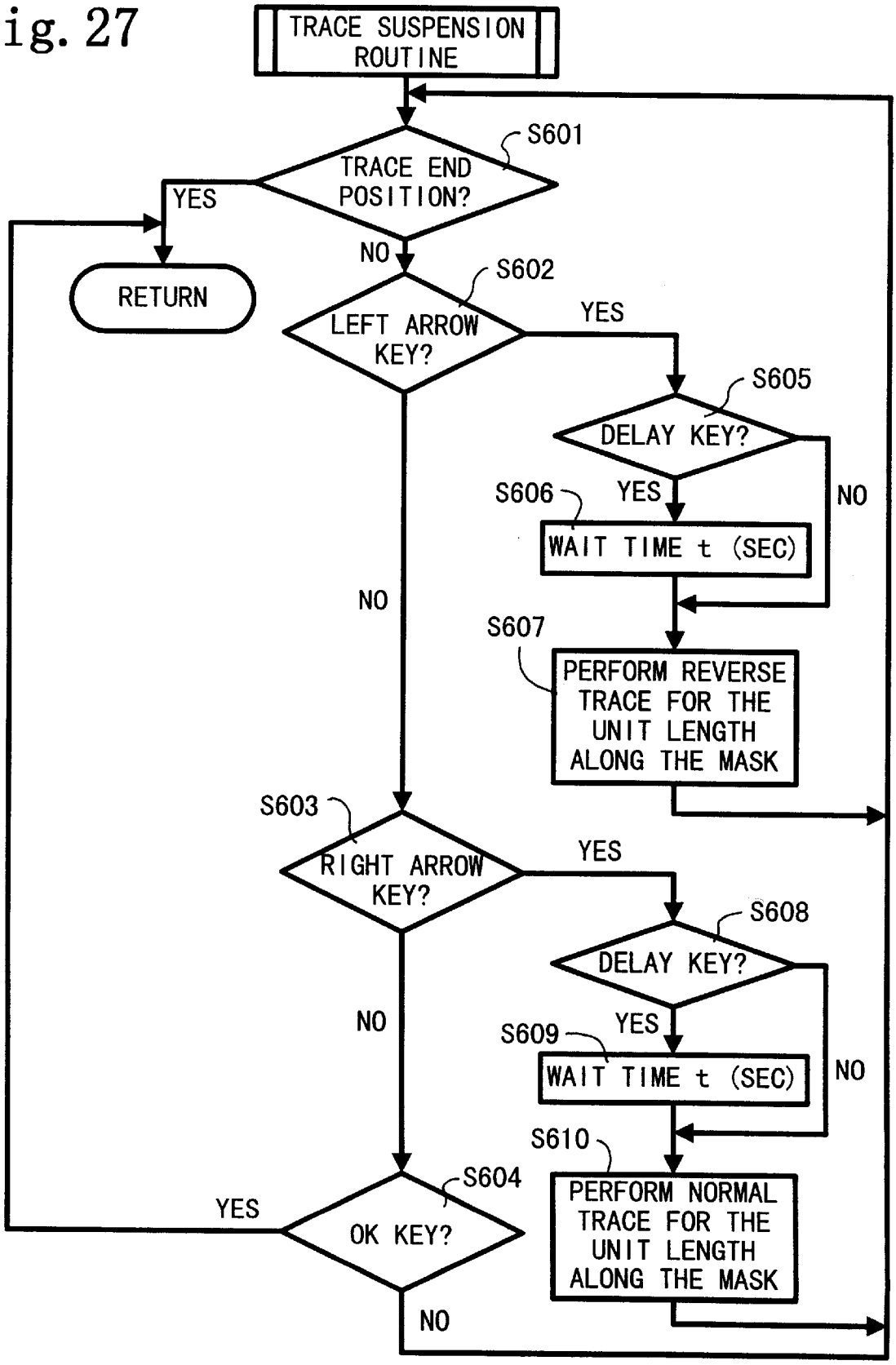
FIG. 27 is a flowchart showing a trace suspension routine.
Figure 28:
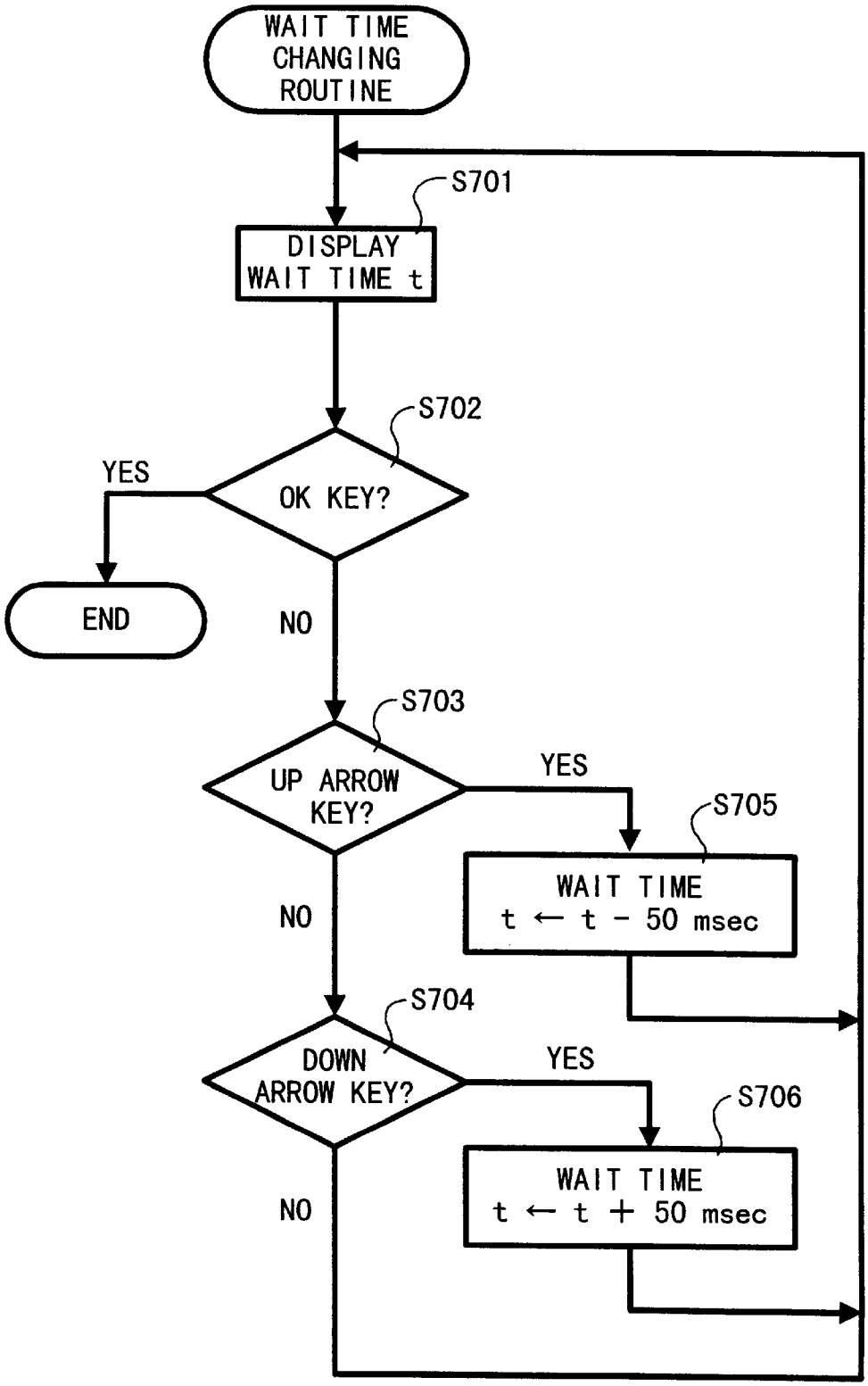
FIG. 28 is a flowchart showing a wait time change routine.

FIG. 27 shows a routine executed while the trace is suspended. In this routine, it is possible to perform a reverse trace where the trace is performed in the reverse direction. FIG. 28 shows a wait time changing routine to set a wait time. Depending on the wait time, the trace speed during the time the DELAY key 118*c* is pressed can be changed. The CPU 171 in the routine corresponds to a reverse trace executing device because it enables the direction of the trace to be reversed.

The wait time changing routine of FIG. 28 will be described first. The purpose of the routine is to set a wait time t (sec.) that affects the trace speed while the operator presses the DELAY key 118*c*. The operator can execute this routine during or before the trace operation by pressing the WAIT key 118*g*.

When the WAIT key 118*g* is pressed, the CPU 171 first displays a default value of the wait time t (sec.) on the LCD display 117 (S701). If the wait time t displayed on the LCD display 117 is appropriate, the operator presses the OK key 118*a* (S702: Yes), and the CPU 171 finishes the routine. If the operator does not press the OK key 118*a* (S702: No), the CPU 171 checks whether one of the up or down arrow keys 118*d* is pressed (S703, S704).

When the operator presses the up arrow key (S703: Yes), the CPU 171 shortens the wait time t by 50 msec (S705) and displays the shortened wait time t (S701). When the operator presses the down arrow key (S703: No, S704: Yes), the CPU 171 increases the wait time t by 50 msec (S706) and displays the increased wait time t (S701). Because the wait time t can be changed in 50 msec intervals, the operator continues to press the appropriate key until the desired wait time is displayed (S701), and presses the OK key 118*a* (S702: Yes).

Using the up and down arrow keys 118*d*, the operator can adjust the wait time t so as to perform normal trace and reverse trace at a desired speed. The up and down arrow keys 118*d* which are executed at S703 and S704 comprise a speed setting member.

When the operator presses the TRACE key 118*f* to select a trace mode as described above, the CPU 171 executes steps of the flowchart of FIG. 22.

If the operator selects "all corners slowdown" (S101: Yes), the CPU 171 goes into an all corners slowdown routine (S105). The all corners slowdown means the trace speed is slowed down around a point on each corner, for example, at 10 pulses before and after a point, such as point 196*a*.

If the operator selects "next corner stop" (S102: Yes), the CPU 171 executes a next corner stop routine (S105). The next corner stop is used during the trace operation, and means the trace is stopped at the next corner to come after the operator has pressed the "OK" key. For example, if the "next corner stop" is selected while the trace is performed on the point 196*e* of the mask data 196 in FIG. 21, the trace will be stopped for a predetermined time at the point 196*b* on a corner, which comes next after the point 196*e*.

If the operator selects the "specified corner stop" (S103: Yes), the CPU 171 execute a specified corner stop routine (S107). The "specified corner stop" is used during the trace operation, and means a corner, such as the point 196*c*, where the trace is stopped can be specified by number. For example, when trace is performed along the mask data 196, the points 196*c*, 196*d*, 196*b* can be previously numbered as 1, 2, 3, respectively. If the operator wants to stop the trace at point 196*d* during trace operation, the operator inputs number "2" through the number key pad 118*e* on the operation panel 118.

When the operator does not select any of "all corners slowdown", "next corner stop", and "specified corner stop" (S101, S102, S103: No), the CPU 171 executes the trace routine (S104, FIG. 23).

The trace routine shown in FIG. 23 will now be described. In the trace routine, the CPU 171 first determines whether the trace is completed (S201). If the trace is completed up to the end position (S201: Yes), the trace routine is terminated. If it is not the end position (S201: No), the CPU 171 performs the trace for a unit length by relatively moving the embroidery frame 116*c* (S202).

The unit length is equivalent to one pulse of the pulse motor that moves the movable frame 116 (the embroidery frame 116*c*). Namely, the movable frame 116 (the embroidery frame 116*c*) is moved approx. 0.1 mm in the X- or Y-axis direction by driving the X-axis driving motor 186 or the Y-axis driving motor 188 for one pulse only. When the stop key 118*b* is not pressed (S203: No) or the DELAY key 118*c* is not pressed (S204: No), the CPU 171 repeats steps S201 to S204 until the trace operation reaches the end position (S201: Yes).

During the trace routine shown in FIG. 23, when the stop key 118*b* is not pressed (S203: No) and the DELAY key 118*c* is pressed (S204: Yes), the CPU 171 stops the trace operation for t seconds (S206). The time t seconds is the one determined using the OK key 118*d* in the flowchart of FIG. 28 (S702: Yes).

The trace is stopped only for t seconds during the trace routine, and the trace speed is slowed down as a result. The DELAY key 118*c* executed at S204 in FIG. 23 corresponds to a speed reducing member. The trace speed is kept reduced at a constant slower speed so long as the operator presses the DELAY key 118*c*, however, the trace speed returns to its original speed when the operator releases the DELAY key 118*c*. The trace speed can be promptly changed in this manner, which greatly increases the convenience of operation of the machine M.

When the STOP key 118*b* is pressed during the trace routine in FIG. 23 (S203: Yes), the CPU 171 goes into a trace suspension routine (S205).

The trace suspension routine will be now described with reference to FIG. 27. The purpose of the routine is to stop the trace temporarily and forward and backward the trace step by step using the left or right arrow key 118*d* shown in FIG. 18.

The CPU 171 determines whether the trace is completed (S601). If the trace is completed up to the end position (S601: Yes), the trace routine is terminated. If it is not at the end position (S601: No), the CPU 171 checks whether the left or right arrow key 118*d* (S602, S603) or the OK key 118*a* (S604) is pressed. When the left and right arrow keys are not pressed (S602, S603: No) but the OK key is pressed (S604: Yes), the CPU 171 terminates the trace suspension routine.

When the operator continues to press the left arrow key 118*d* (S602: Yes) and does not press the DELAY key 118*c* (S605: No), the CPU 171 allows the trace operation to reverse for the unit length along the mask data 196 (S607). When the operator continues to press both the left arrow key 118*d* (S602: Yes) and the DELAY key 118*c* (S605: Yes), the CPU 171 stops the trace operation for t seconds (S606) to reduce the trace speed, and then allows the trace operation to reverse for the unit length (S607).

When the operator continues to press the right arrow key 118*d* (S603: Yes) and does not press the DELAY key 118*c* (S608: No), the CPU 171 allows the trace operation to advance for the unit length along the mask data 196 (S610). When the operator continues to press both the right arrow key 118*d* (S603: Yes) and the DELAY key 118*c* (S608: Yes), the CPU 171 stops the trace operation for t seconds (S609) to reduce the trace speed, and then allows the trace operation to reverse for the unit length (S610). Then, the CPU repeats steps S601 to S610.

In the trace suspension routine, the reverse trace can be performed with the operation of the left arrow key 118*d*. Therefore, the left arrow key 118*d* corresponds to both an operating member and a second specifying device. The reverse trace is performed while the operator presses the left arrow key 118*d*, and is canceled when the operator releases the left arrow key 118*d*. The performance of the reverse trace can be promptly changed in this manner, which greatly increases the convenience of operation of the machine M.

In addition, the right arrow key 118*d* corresponds to a first specifying device. The trace is performed while the operator presses the right arrow key 118*d*, and is canceled when the operator releases the right arrow key 118*d*. The performance of the trace can also be promptly changed in this manner, which greatly increases the convenience of operation of the machine M.

Next is a description of the all corners slowdown routine as selected in the trace mode selection routine (S101: Yes) in FIG. 22. At this time, the CPU 171 executes an all corners slowdown routine (S105).

In FIG. 24, if the trace is completed up to the end position (S301: Yes), the trace routine is terminated. If it is not the end position (S301: No), the CPU 171 sequentially checks whether one of the STOP key (S302) and the DELAY key (S303) are pressed. If the STOP key is pressed (S302: Yes), the CPU 171 executes the trace suspension routine (S304) as shown in FIG. 27. If the stop key is not pressed (S302: No) and the DELAY key is pressed (S303: Yes), the CPU 171 stops the trace for time t predetermined in the routine of FIG. 28 (S305).

Further, when the DELAY key is not pressed (S303: No) or after the trace is stopped for t seconds (S305), the CPU 171 checks whether the current position is close to a corner (S306). When the current position is within 10 pulses before and after a corner, the CPU 171 presumes that it is close to the corner. If the current position is close to the corner (S306: Yes), it is stopped one second at every pulse (S307). Namely, when the trace moves to points 196*c*, 196*d*, 196*b* , 196*a*, and 196*c* on the corners, it is stopped within vicinity of the corners for one second at every pulse.

Then, the CPU 171 moves the embroidery frame 16*c* for the unit length (for one pulse) along the mask data 196 (S308) to reduce the trace speed, and returns to S301. When the current position is not close to a corner (S306: No), the CPU 171 moves the embroidery frame 16*c* for the unit length (for one pulse) without slowdown of the trace speed (S308). The CPU 171 repeats the above steps until the trace is completed up to the end position (S301: Yes).

The operator can easily select the all corners stop trace mode, by touching the display 117, and reduce the trace speed at which the direction of the trace changes by pressing the DELAY key 118*c*, as described above. Due to these advantages, the operator can easily recognize the trace position within the embroidery frame 116*c*.

Therefore, the DELAY key 118*c*, at S303, corresponds to a speed reducing member around a place where the direction of the trace changes.

The next corner stop routine, as selected in the trace mode selection routine (S102: Yes) of FIG. 22, will now be described. At this time, the CPU 171 goes into a next corner stop routine (S106). In FIG. 25, the CPU 171 sets a corner stop flag to 0 (S401). If the trace is completed up to the end position (S402: Yes), the CPU 171 terminates the trace operation.

If the trace does not reach the end position (S402: No), the CPU 171 checks whether one of the OK key 118*a* (S403), the STOP key 118*b* (S404), and the DELAY key 118*c* (S405) are pressed. When the OK key 118*a* is pressed (S403: Yes), the CPU 171 sets the flag to 1 (S406). When the STOP key 118*b* is pressed (S404: Yes), the CPU 171 goes into the trace suspension routine (S407) shown in FIG. 27.

Getting back from the trace suspension routine (S601, S604: Yes), the CPU 171 returns to step S402. If the STOP key 118*b* is not pressed (S404: No), the trace suspension routine (FIG. 27) is not executed. When the DELAY key 118*c* is pressed (S405: Yes), the trace speed is reduced because the CPU 171 stops the trace for t seconds (S408) as described above. If the DELAY key is not pressed (S405: No), the trace speed is not reduced.

Then, the CPU 171 checks the corner stop flag (S409). If the corner stop flag is not set to 1 (S409: No), the CPU 171 performs the trace operation for the unit length along the mask data 196 (S413). If the corner stop flag is set to 1 (S409: Yes), the CPU 171 checks whether the current position is on a corner (S410). If the current position is on the corner (S410: Yes), the CPU stops the trace operation for two seconds (S411), sets the corner stop flag to 0 (S412), and performs the trace operation for the unit length along the mask data 196 (S413). If the current position is not on the corner (S410: No), the CPU 171 performs the trace operation for the unit length along the mask data 196 (S413).

The CPU 171 repeats the above-mentioned steps S403 to S413 until the trace reaches the end position (S402: Yes). When the next corner stop is requested while the trace is passing the point 196*e* in the act of moving to points 196*c*, 196*d*, 196*b* , 196*a*, and 196*c* on the corners, the trace is temporarily stopped at the point 196*b* on the corner which comes next to the point 196*e*. It is easy to request the next corner stop. The operator just touches the indication of the next corner stop on the display 117, and presses the OK key 118*a* at S403 of FIG. 25. These actions allow the trace operation to stop at a next corner, and as a result, the operator can easily confirm where the trace position is in the embroidery frame 116*c* in the stop condition. Therefore, the OK key 118*a* at S403 corresponds to a stopping member for the next stop position.

The next description is for the case where the specified corner stop routine is selected in the trace mode selection routine (S103: Yes) in FIG. 22. At this time, the CPU 171 goes into a specified corner stop routine (S107).

In FIG. 26, the CPU 171 initializes the system by setting a corner stop parameter to 0 and the current corner parameter to 0 (S501). If the trace is completed up to the end position (S502: Yes), the CPU 171 terminates the trace operation. If the trace does not reach the end position (S502: No), the CPU 171 checks whether one of the number keys 118*e* (S503), the STOP key 118*b* (S504), and the DELAY key 118*c* (S505) are pressed.

When a number key 118*e* is pressed (S503: Yes), the CPU 171 sets the corner stop parameter to the same number as the key pressed (S506). Because the numbers for the corners are assigned in the order the trace passes, number 1 corresponds to point 196*c*, number 2 to point 196*d*, number 3 to point 196*b* , and number 4 to point 196*a*. If the operator wants to stop the trace at point 196*d*, the operator inputs number 2 from the number key 118*e* on the operation panel 118.

If a number key 118*e* is not pressed (S503: No), the corner stop parameter remains 0, and the CPU 171 advances to the next step. When the STOP key 118*b* is pressed (S504: Yes), the CPU 171 executes the trace suspension routine (S507) as shown in FIG. 27.

After executing the trace suspension routine (S601, S604: Yes), the CPU 171 returns to step S502. If the STOP key 118*b* is not pressed (S504: No), the trace suspension routine (FIG. 27) is not executed. When the DELAY key 118*c* is pressed (S505: Yes), the trace speed is reduced because the CPU 171 stops the trace for t seconds (S508) as described above. If the DELAY key 118*c* is not pressed (S505: No), the trace speed is not reduced.

Then, the CPU 171 checks whether the current position is on a corner (S509). If the current position is on the corner (S509: Yes), the CPU adds 1 to the current corner parameter (S510) and checks the corner stop parameter (S511). If the current position is not on the corner (S509: No), the CPU 171 performs the trace operation for the unit length (for one pulse) along the mask data 196 (S515). Furthermore, if the corner stop parameter is not 0 (S511: Yes), the CPU 171 compares the current corner parameter with the corner stop parameter (S512). If these parameters match (S512: Yes), the corner is regarded as the specified one, and the CPU stops the trace for two seconds (S513), and sets the corner stop parameter to 0 (S514). In short, the trace is stopped for two seconds at the point 196*d* on the corner corresponding to "2" inputted by the number key 118*e*.

If the corner stop parameter is 0 (S511: No), the trace is performed for the unit length only (for one pulse only) along the mask data 196 (S515). If the current corner parameter does not match the corner stop parameter (S512: No), the trace is performed for the unit length only (for one pulse only) along the mask data 196 (S515) so as to continue the trace operation.

The CPU 171 repeats the above steps until the trace reaches the end position (S502: Yes). Thus, it is easy to stop the trace at a corner during the trace operation. The operator just inputs a desired number indicating a corner where the operator wants to stop the trace. As a result, the operator can easily confirm where the trace position is in the embroidery frame 116*c* in the stop condition. Therefore, the number key 118*e* at S503 corresponds to an operating member for specifying a stop position. In the trace routine illustrated in FIG. 23, when the operator presses the STOP key 118*b* (S203: Yes), the CPU 171 continuously executes the trace suspension routine (S205) until the operator presses the OK key 118*a* (S601: Yes, in FIG. 27). The STOP key 118*b* and the OK key 118*a* correspond to an operating member for specifying a stop position.

The trace is suspended once the operator presses the STOP key 118*b*, and is resumed when the operator presses the OK key 118*a*. The performance of the trace operation can be promptly changed in this manner, which greatly increases the convenience of operation of the machine M.

Therefore, the machine M is capable of embroidering a pattern on the work cloth C3 by relatively moving the needle 122 driving vertically and the embroidery frame 116*c* holding the work cloth C3. With the needle 122 above the work cloth C3, when in the trace mode, in which the needle 122 and the embroidery frame 116*c* are moved relatively in a predetermined direction along an embroidery trace, the CPU 171 functions as a device for executing the normal trace and the reverse trace (FIGS. 22 and 23), enabling the selection of the trace mode, such as the all corners slowdown mode (FIG. 24), the next corner stop trace mode (FIG. 25), the specified corner stop mode (FIG. 26), and the trace suspension mode (FIG. 27), and change of the wait time (FIG. 28).

During the trace suspension mode (FIG. 27), the direction of the trace can be reversed, the trace speed can be changed temporarily, and trace operation can be suspended. These advantages offer greater flexibility in trace operation, realizing prompt and accurate trace with no trouble.

The invention has been described according to the second embodiment. However, it should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. For example, the reverse trace where the trace is performed in the reverse direction is only used in the trace suspension mode of FIG. 27, however it is not limited to this case. Some modifications of the second embodiment will be now described.

For example, the reverse trace may be executed automatically by any programs without any operation by the operator. Further, the method of setting a wait time is just exemplary. It can be changed as necessary.

In the second embodiment, the operator is allowed to specify one corner in the specified corner stop mode. However, more than one corner can be specified.

The operation panel 118 is attached to the auxiliary table 115 in the embodiment. Instead, a wired or wireless remote control switch can be used.

As to trace method, the trace is performed along a rectangle mask data so as to completely cover an embroidery area, i.e., the maximum positions in the X- and Y-axis directions are confirmed only. Instead of the rectangle mask data, an outline of embroidery data can be traced as described in the first embodiment. The shape of the embroidery frame 116*c* can be octagon or other polygon in addition to the above-mentioned shape. Further, each embroidery frame 116*c* can be moved independently. The invention can be applied to a control system embedded into a sewing machine other an embroidery machine, such as a cycle machine.

Furthermore, the first embodiment and the second embodiment can be combined in a sewing machine. Thus, the sewing machine can aid in tracing an embroidery area with much higher flexibility because it enables user-oriented trace operations described in both the first and second embodiments, and their combinations.

What is claimed is:

1. A sewing machine capable of tracing an embroidery area by relatively moving a needle bar as a sewing device and an embroidery frame which holds a work cloth on which an embroidery pattern is embroidered based on embroidery data, the sewing machine comprising:

a calculating device that calculates a convex polygon with a multiple of eight enclosing the pattern, from the embroidery data, and positions of a plurality of vertexes comprised of the convex polygon; and a trace device that traces the embroidery area based on the vertexes found by the calculating device.

2. A sewing machine capable of tracing an embroidery area by relatively moving a needle bar as a sewing device and an embroidery frame which holds a workpiece on which an embroidery pattern is embroidered based on embroidery data, the sewing machine comprising:

a calculating device that calculates a convex octagon that circumscribes a plurality of needle points of all points comprised of an outline of the pattern using predetermined graphic arithmetic logic, and positions of eight vertexes of the convex octagon; and a trace device that traces the embroidery area based on the eight vertexes found by the calculating device.

3. The embroidery machine according to claim 2, wherein the calculating device calculates the convex octagon having a side with an inclination of 45 degrees in respect to an X axis when the embroidery data is represented on an X–Y coordinate system.

4. The embroidery machine according to claim 2, wherein the calculating device creates a convex octagon having minimal area, the pattern initially enclosed within a polygon having equal length sides and the number of sides being a multiple of eight, a first side being moved to contact a first vertex of the embroidery pattern, the line contacting the vertex being parallel to the original line, a line rotated from the first vertex to an extending second vertex in either a clock wise or counter clockwise direction and a line segment of the polygon adjacent the first moved line being moved in a parallel manner to contact the second vertex, a line rotated from the second vertex to an extending next vertex and another line segment adjacent the second line segment moved in a parallel manner to contact the next vertex, the process continuing until the rotated line contacts the first vertex.

5. A sewing machine capable of tracing an embroidery area by relatively moving a needle bar as a sewing device and an embroidery frame which holds a work piece on which an embroidery pattern is embroidered based on embroidery data, the sewing machine comprising:

a calculating device that calculates an envelope polygon covering the embroidery pattern inside by finding a first vertex that is a point of a plurality of needle points on the outline of the pattern that is met first or last with a line having an inclination when it is moved in parallel based on the embroidery data, and a next vertex that is a point that is met first with a line that passes through the first vertex when it is turned on it, and by repeating this until a last vertex is found, and calculates a position of each of the vertexes comprised of the envelope polygon; and a trace device that traces the embroidery area based on the vertexes found by the calculating device.

6. A sewing machine capable of tracing an embroidery area by relatively moving a needle bar as a sewing device and an embroidery frame which holds a workpiece on which a pattern is embroidered based on embroidery data, comprising:

a calculating device that calculates a circle covering the embroidery pattern inside based on the embroidery data; and a trace device that traces the embroidery area along the circle found by the calculating device.

7. The embroidery machine according to claim 6, wherein the calculating device calculates a center point of an imaginary rectangle which circumscribes the outline of the embroidery pattern, and a distance from the center point to the farthest point of all points on the outline as a radius, and finally finds the circle specified with the center point and the radius.

8. A sewing machine capable of tracing an embroidery area by relatively moving a needle bar as a sewing device and an embroidery frame which holds a workpiece on which a pattern is embroidered based on embroidery data, comprising:

a trace shape selecting device that selects a trace shape from a plurality of various shape alternatives;

a calculating device that calculates a trace shape selected through the trace shape selecting device based on the embroidery data so that it can cover an embroidery pattern inside; and trace device that traces the embroidery area along the trace shape found by the calculating device.

9. A sewing machine capable of tracing an embroidery area by relatively moving a needle bar as a sewing device and an embroidery frame which holds a workpiece on which an embroidery pattern is embroidered based on embroidery data, comprising a reverse trace executing device that moves the embroidery frame in an opposite direction, to a predetermined trace direction, in a trace mode, wherein the needle and the embroidery frame are relatively moved along a predetermined path of the embroidery area for the pattern in the opposite direction of the predetermined trace direction.

10. The sewing machine according to claim 9, wherein the reverse trace executing device executes reverse trace only while an operating member for execution is manipulated.

11. The sewing machine according to claim 9, further comprising:

a first specifying device that specifies a normal trace mode; and a second specifying device that specifies a reverse trace mode where the direction of the trace is reversed.

12. The sewing machine as in claim 9, wherein the reverse trace executing device allows a speed of the reverse trace to be changed only while a speed changing member is manipulated.

13. The sewing machine as in claim 9, wherein the reverse trace executing device sets the speed of the reverse trace when a speed setting member is manipulated.

14. The sewing machine as in claim 9, wherein the reverse trace executing device reduces the speed of the reverse trace around a place where the direction of the trace operation changes when a speed reducing member is manipulated.

15. The sewing machine as in claim 9, wherein the reverse trace executing device stops the trace operation at a next stop position when a stopping member for the next stop position is manipulated.

16. The sewing machine as in claim 9, wherein the reverse trace executing device specifies a stop position for the trace operation when an operating member for specifying stop position is manipulated.

17. A sewing machine capable of tracing an embroidery area by relatively moving a needle bar as a sewing device and an embroidery frame which holds a workpiece on which an embroidery pattern is embroidered based on embroidery data, comprising:

a calculating device that calculates a trace pattern that encloses a selected embroidery pattern; and a speed changing device that changes a speed of a trace operation along the trace pattern in a trace mode where the needle and the embroidery frame are relatively moved in a predetermined direction alone a path of the trace pattern, wherein the speed changing device changes the speed of the trace operation only while a speed changing member is manipulated.

18. A sewing machine capable of tracing an embroidery area by relatively moving a needle bar as a sewing device and an embroidery frame which holds a workpiece on which an embroidery pattern is embroidered based on embroidery data, comprising:

a calculating device that calculates a trace pattern that encloses a selected embroidery pattern; and a trace stopping device that stops a trace operation along the trace pattern only when an operating member for specifying a stop position is manipulated in a trace mode where the needle and the embroidery frame are relatively moved in a predetermined direction along a path of the trace pattern.

19. A sewing machine capable of sewing an embroidery pattern by relatively moving at least one sewing needle and a corresponding embroidery frame, the sewing machine comprising:

a calculating device for calculating a trace pattern based upon, and enclosing, a selected pattern;

a control system controlling the at least one sewing needle and embroidery frame to conduct a trace of the trace pattern to confirm whether the selected embroidery pattern lies within the embroidery frame, when traced using at least one of a forward and a reverse trace direction; and a selection system enabling selection of the forward and reverse trace direction, the selection system further enabling selection of a trace speed.

20. The sewing machine according to claim 19, wherein the selection system allows selection of a corner stop mode, a selected corner stop mode, a trace speed slow down in a vicinity of a corner mode, and a standard trace speed mode as the trace speed.

21. The sewing machine according to claim 19, wherein the calculating device calculates the trace pattern as one of a rectangular pattern, an octagonal pattern, an envelope polygram pattern, and a circle pattern.

22. The sewing machine according to claim 20, wherein the calculating device calculates the trace pattern as one of a rectangular pattern, an octagonal pattern, an envelope polygram pattern, and a circle pattern.

23. The sewing machine according to claim 21, further comprising an automatic trace pattern selection device that directs the calculating device to calculate the trace pattern of a specified type on a basis of the selected pattern.

24. The sewing machine according to claim 22, further comprising an automatic trace pattern selection device that directs the calculating device to calculate the trace pattern of a specified type on a basis of the selected pattern.

25. The sewing machine according to claim 21, further comprising a frame detector that identifies the type embroidery frame mounted to the sewing machine, wherein the control system directs the calculating system to calculate the trace pattern based on the identified embroidery frame.

26. The sewing machine according to claim 22, further comprising a frame detector that identifies the type embroidery frame mounted to the sewing machine, wherein the control system directs the calculating system to calculate the trace pattern based on the identified embroidery frame.

27. The sewing machine according to claim 21, wherein the calculating device when calculating the octagonal pattern can create a pattern having a number of vertices divisible by eight and the selection system allows selection of a multiple of eight.

28. The sewing machine according to claim 22, wherein the calculating device when calculating the octagonal pattern can create a pattern having a number of vertices divisible by eight and the selection system allows selection of a multiple of eight.

29. The sewing machine according to claim 21, further comprising, at least, a stop switch and a delay switch for temporarily stopping and delaying, respectively, execution of the trace pattern.

30. The sewing machine according to claim 22, further comprising, at least, a stop switch and a delay switch for temporarily stopping and delaying, respectively, execution of the trace pattern.

31. A sewing machine capable of tracing an embroidery area by relatively moving a needle bar as a sewing device and an embroidery frame which holds a workpiece on which an embroidery pattern is embroidered based on embroidery data, comprising a speed changing device that changes a speed of a trace operation in a trace mode where the needle and the embroidery frame are relatively moved in a predetermined direction along a predetermined path of the embroidery area for the pattern, the speed changing device decreasing the speed of the trace operation only while a speed changing member is manipulated.

* * * * *